US012061030B2

(12) United States Patent
Petersen et al.

(10) Patent No.: US 12,061,030 B2
(45) Date of Patent: Aug. 13, 2024

(54) REFRIGERATION SYSTEMS AND METHODS

(71) Applicant: HONEYWELL INTERNATIONAL INC., Charlotte, NC (US)

(72) Inventors: Michael Petersen, Charlotte, NC (US); Gustavo Pottker, Charlotte, NC (US); Samuel F. Yana Motta, Charlotte, NC (US); Ronald Peter Vogl, Charlotte, NC (US); Ankit Sethi, Charlotte, NC (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 585 days.

(21) Appl. No.: 17/258,950

(22) PCT Filed: Jul. 9, 2019

(86) PCT No.: PCT/US2019/040995
§ 371 (c)(1),
(2) Date: Jan. 8, 2021

(87) PCT Pub. No.: WO2020/014220
PCT Pub. Date: Jan. 16, 2020

(65) Prior Publication Data

US 2021/0123637 A1 Apr. 29, 2021

Related U.S. Application Data

(60) Provisional application No. 62/695,658, filed on Jul. 9, 2018.

(51) Int. Cl.
*F25B 5/00* (2006.01)
*F25B 5/02* (2006.01)
(Continued)

(52) U.S. Cl.
CPC ..... *F25B 5/00* (2013.01); *F25B 5/02* (2013.01); *F25B 6/04* (2013.01); *F25B 7/00* (2013.01); *F25B 9/006* (2013.01); *F25B 40/02* (2013.01); *F25B 41/20* (2021.01); *F25B 2400/0401* (2013.01); *F25B 2400/051* (2013.01); *F25B 2400/053* (2013.01); *F25B 2400/121* (2013.01); *F25B 2600/2501* (2013.01); *F25B 2600/2507* (2013.01)

(58) Field of Classification Search
CPC .. F25B 40/00; F25B 41/20; F25B 5/00; F25B 5/02; F25B 6/04; F25B 7/00; F25B 9/006;
(Continued)

(56) References Cited

U.S. PATENT DOCUMENTS 4,947,655 A 8/1990 Shaw
6,148,634 A 11/2000 Sherwood
(Continued)

FOREIGN PATENT DOCUMENTS

KR 101129116 B1 3/2012
WO 2017027701 A1 2/2017
WO 2017099814 A1 6/2017

OTHER PUBLICATIONS

International Search Report in related International Patent Application No. PCT/US2019/040995, mailed Oct. 25, 2019, 3 pages.
(Continued)

*Primary Examiner* — Ana M Vazquez
(74) *Attorney, Agent, or Firm* — FisherBroyles, LLP; Joseph F. Posillico

(57) ABSTRACT

Cascaded refrigeration systems containing: a plurality of refrigeration units, each refrigeration unit containing a first refrigeration circuit, each first refrigeration circuit comprising an evaporator and a heat exchanger; and a second refrigeration circuit; wherein each first circuit heat exchanger is arranged to transfer heat energy between its respective first refrigeration circuit and the second refrigeration circuit.

20 Claims, 9 Drawing Sheets

(51) Int. Cl.

| | |
|---|---|
| ***F25B 6/04*** | (2006.01) |
| ***F25B 7/00*** | (2006.01) |
| ***F25B 9/00*** | (2006.01) |
| ***F25B 40/02*** | (2006.01) |
| *F25B 41/20* | (2021.01) |

(58) Field of Classification Search
CPC ..... F25B 40/02; F25B 2400/0401; F25B 2400/051; F25B 2400/053
See application file for complete search history.

(56) References Cited

U.S. PATENT DOCUMENTS

| | | | | |
|---|---|---|---|---|
| 10,634,424 | B2 * | 4/2020 | Saunders | F25B 49/02 |
| 2006/0101848 | A1 * | 5/2006 | Taras | F25B 39/00 165/172 |
| 2012/0216551 | A1 | 8/2012 | Minor et al. | |
| 2013/0180278 | A1 | 7/2013 | Yamashita et al. | |
| 2014/0150492 | A1 | 6/2014 | Davies et al. | |
| 2014/0260382 | A1 | 9/2014 | Yana Motta et al. | |
| 2015/0285539 | A1 | 10/2015 | Kopko | |
| 2016/0320105 | A1 | 11/2016 | Okazaki | |
| 2017/0089614 | A1 | 3/2017 | Miyagi et al. | |

OTHER PUBLICATIONS

A lower GWP option for flooded systems, coolingpost, Apr. 5, 2016, https://www.coolingpost.com/world-news/a-lower-gwp-option-for-flooded-systems/ (year:2016).

International Search Report in related International Patent Application No. PCT/US2018/038854, mailed Oct. 26, 2018, 3 pages.

International Search Report in related International Patent Application No. PCT/US2018/038807, mailed Oct. 26, 2018, 3 pages.

* cited by examiner

REFRIGERATION SYSTEMS AND METHODS

CROSS REFERENCE TO RELATED APPLICATIONS

The present application is related to and claims the priority benefit of U.S. Provisional application 62/695,658, filed Jul. 9, 2018, which is incorporated herein by reference.

FIELD

The disclosure relates to cascaded refrigeration systems and methods, particularly, but not exclusively, to cascaded refrigeration systems and methods having exceptional performance in use with certain low GWP refrigerants.

BACKGROUND

The refrigeration industry is under increasing pressure—through regulatory changes and otherwise—to replace high global warming potential (GWP) refrigerants, such as R404A, with low GWP refrigerants, such as refrigerants with GWP below 150. This is of particularly importance in the commercial refrigeration system, where high volumes of refrigerant are used.

One approach has been to use low GWP refrigerants, such as carbon dioxide (R744) and hydrocarbon refrigerants. However, such an approach as has been heretofore used can suffer from significant safety and financial drawbacks, such as: poor system energy efficiency, leading to increased operating costs; high system complexity, leading to high initial system costs; low system serviceability and reliability, leading to high maintenance costs; and high system flammability. Systems which include highly flammable refrigerants according to prior arrangements have been particularly disadvantageous as they can lead to poor levels of safety; can conflict with regulatory code restrictions; and can increase liability on refrigeration system operators and manufacturers. Safety is a particular concern given that many commercial refrigeration applications, such as supermarket fridges, freezers and cold display cases are publically accessible and often operate in densely populated spaces.

Applicants have come to appreciate, therefore, that the refrigeration industry continues to need safe, robust and sustainable approaches for reducing the use of high GWP refrigerants which can be used with existing technologies.

One such approach that has been previously used is shown in FIG. 1A. FIG. 1 shows a refrigeration system 100 which is commonly used for commercial refrigeration in supermarkets. The system 100 is a direct expansion system which provides both medium and low temperature refrigeration via medium temperature refrigeration circuit 110 and low temperature refrigeration circuit 120.

In a typical prior configuration labelled as 100 in FIG. 1A, the medium temperature refrigeration circuit 110 has R134a as its refrigerant. The medium temperature refrigeration circuit 110 provides both the medium temperature cooling and removes the rejected heat from the lower temperature refrigeration circuit 120 via a heat exchanger 130. The medium temperature refrigeration circuit 110 extends between a roof 140, a machine room 141 and a sales floor 142. The low temperature refrigeration circuit 120 on the other hand has R744 as its refrigerant. The low temperature refrigeration circuit 120 extends between the machine room 141 and the sales floor 142. Usefully, as discussed above, R744 has a low GWP.

However, while refrigeration systems of the type disclosed in FIG. 1A may be able to provide good efficiency levels, applicants have come to appreciate that systems of this type have at least two major drawbacks: first, such systems use the high GWP refrigerant R134a (R134a having a GWP of around 1300); and second, even though the low temperature portions of such systems uses the low GWP refrigerant R744, this refrigerant exhibits the many drawbacks discussed above, including significant safety and financial drawbacks.

SUMMARY

The present invention includes a cascaded refrigeration system, comprising:

(a) a plurality of low temperature refrigeration circuits, with each low temperature refrigeration circuit comprising:

(i) a flammable low temperature refrigerant having a GWP of about 150 or less;

(ii) a compressor having a horse power rating of about 2 horse power or less; and (iii) a heat exchanger in which said flammable low temperature refrigerant condenses within the range of temperatures of from about −5° C. to about −15° C.; and (b) a medium temperature refrigeration circuit comprising a non-flammable medium temperature refrigerant selected from the group consisting of R515A, R515B, FH, A1 (HDR-127), A2 (HDR-128) (all as defined herein, including in Table 6a) evaporating at a temperature below said low temperature refrigerant condensing temperature and in the range of about −5° C. to about −15° C., wherein said medium temperature refrigerant evaporates in said heat exchanger by absorbing heat from said flammable refrigerant in said low temperature refrigeration circuit. For the purposes of convenience, systems in accordance with this paragraph are sometimes referred to herein as System 1.

The present invention includes a cascaded refrigeration system, comprising:

(a) a plurality of low temperature refrigeration circuits, with each low temperature refrigeration circuit comprising:

(i) a flammable low temperature refrigerant consisting essentially of HFO-1234yf and/or R-455A and/or propane and having a GWP of about 150 or less;

(ii) a compressor having a horse power rating of about 2 horse power or less; and (iii) a heat exchanger in which said flammable low temperature refrigerant condenses within the range of temperatures of from about −5° C. to about −15° C.; and (b) a medium temperature refrigeration circuit comprising a non-flammable medium temperature refrigerant selected from the group consisting of R515A, R515B, FH, A1 (HDR-127), A2 (HDR-128) (all as defined herein, including in Table 6a) evaporating at a temperature below said low temperature refrigerant condensing temperature and in the range of about −5° C. to about −15° C., wherein said medium temperature refrigerant evaporates in said heat exchanger by absorbing heat from said flammable refrigerant in said low temperature refrigeration circuit. For the purposes of convenience, systems in accordance with this paragraph are sometimes referred to herein as System 2.

The present invention includes a cascaded refrigeration system, comprising:

(a) a plurality of self-contained low temperature refrigeration circuits, with at least two of such circuits being contained in a separate, modular refrigeration unit and each of said modular refrigeration units being located in a first area open to the public, with each low temperature refrigeration circuit comprising:

(i) a flammable low temperature refrigerant consisting essentially of HFO-1234yf and/or R-455A and/or propane and having a GWP of about 150 or less;

(ii) a compressor having a horse power rating of about 2 horse power or less; and (iii) a heat exchanger in which said flammable low temperature refrigerant condenses within the range of temperatures of from about −5° C. to about −15° C.;

(iv) a suction line heat exchanger connected upstream of said compressor for adding heat to the gas entering the compressor; and (b) a medium temperature refrigeration circuit comprising a non-flammable medium temperature refrigerant selected from the group consisting of R515A, R515B, FH, A1 (HDR-127), A2 (HDR-128) (all as defined herein, including in Table 6a) evaporating at a temperature below said low temperature refrigerant condensing temperature and in the range of about −5° C. to about −15° C., wherein said medium temperature refrigerant evaporates in said heat exchanger by absorbing heat from said flammable refrigerant in said low temperature refrigeration circuit. For the purposes of convenience, systems in accordance with this paragraph are sometimes referred to herein as System 3.

The present invention includes a cascaded refrigeration system, comprising:

(a) a plurality of low temperature refrigeration circuits, with each low temperature refrigeration circuit comprising:

(i) a flammable low temperature refrigerant consisting essentially of HFO-1234yf and/or R-455A and/or propane and having a GWP of about 150 or less;

(ii) a compressor having a horse power rating of about 2 horse power or less; and (iii) a heat exchanger in which said flammable low temperature refrigerant condenses within the range of temperatures of from about −5° C. to about −15° C.; and (b) a medium temperature refrigeration circuit comprising a non-flammable medium temperature refrigerant selected from the group consisting of R515A, R515B, FH, A1 (HDR-127), A2 (HDR-128) (all as defined herein, including in Table 6a) evaporating at a temperature below said low temperature refrigerant condensing temperature and in the range of about −5° C. to about −15° C., wherein said medium temperature refrigerant evaporates in said heat exchanger by absorbing heat from said flammable refrigerant in said low temperature refrigeration circuit. For the purposes of convenience, systems in accordance with this paragraph are sometimes referred to herein as System 4.

As used herein, the term "flammable" with respect to a refrigerant means that the refrigerant is not classified as A1 under ASHRAE 34-2016 test protocol defining conditions and apparatus and using the current method ASTM E681-09 annex A1. Accordingly, a refrigerant which is classified as A2L under ASHRAE 34-2016 test protocol defining conditions and apparatus and using the current method ASTM E681-09 annex A1 or is more flammable than the A2L classification, would be considered flammable.

Conversely, the term "non-flammable" with respect to a refrigerant means that the refrigerant is classified as A1 under ASHRAE 34-2016 test protocol defining conditions and apparatus and using the current method ASTM E681-09 annex A1.

As used herein, the term "medium temperature refrigeration" refers to refrigeration circuits in which the refrigerant circulating in the circuit is evaporating at a temperature of from about −5° C. to about −15° C., and preferably at temperature of about −10° C. As used herein with respect to temperatures, the term "about" is understood to mean variations in the identified temperature of +/−3° C. The refrigerant circulating in the medium temperature circuit can evaporate at a temperature of −10° C.+/−2° C., or at −10° C.+/−1° C.

Medium temperature refrigeration of the present invention can be used, for example, to cool products such as dairy, deli meats and fresh food. The individual temperature level for the different products is adjusted based on the product requirements.

Low temperature refrigeration is typically provided at an evaporation level of about −25° C. As used herein, the term "low temperature refrigeration" refers to refrigeration circuits in which the refrigerant circulating in the circuit is evaporating at a temperature of from about −20° C. to about −30° C., and preferably at temperature of about −25° C. The refrigerant circulating in the low temperature circuit can evaporate at a temperature of −25° C.+/−2° C., or at −25° C.+/−1° C.

Low temperature refrigeration of the present invention can be used, for example, to cool products such as ice cream and frozen goods, and again, the individual temperature level for the different products is adjusted based on the product requirements.

The present invention also includes a cascaded refrigeration system, including each of the Systems 1-4, in which said heat exchanger (iii) is a flooded heat exchanger in which said medium temperature refrigerant evaporates in said heat exchanger by absorbing heat from said low temperature refrigerant.

As the term is used herein, "flooded heat exchanger" refers to a heat exchanger is which a liquid refrigerant is evaporated to produce refrigerant vapour with no substantial super heat. As the term is used herein, "no substantial super heat" means that the vapour exiting the evaporator is at a temperature that is not more than 1° C. above the boiling temperature of the liquid refrigerant in the heat exchanger.

The present invention also includes a cascaded refrigeration system, including each of the Systems 1-4, comprising: a plurality of low temperature refrigeration circuits, with each low temperature refrigeration circuit comprising a flammable low temperature refrigerant comprising at least about 50% by weight, or at least about 75% by weight, or at least 95% by weight, or at least 99% by weight of HFO-1234yf, R455A, propane or combinations of these.

The present invention also includes a cascaded refrigeration system, including each of the Systems 1-4, comprising: a plurality of low temperature refrigeration circuits, with each low temperature refrigeration circuit comprising a flammable low temperature refrigerant comprising at least about 50% by weight, or at least about 75% by weight, or at least 95% by weight, or at least 99% by weight of HFO-1234yf, R455A, propane or combinations of these, wherein said heat exchanger is a flooded heat exchanger in which said medium temperature refrigerant evaporates in said heat exchanger by absorbing heat from said low temperature refrigerant.

In preferred embodiments, including in each of Systems 1-4, the second circuit, preferably a medium temperature circuit, may be located substantially completely outside of said plurality of first refrigeration units, preferably outside of said plurality of low temperature circuits. As used herein, the term "substantially completely outside" means that the components of the second refrigeration circuit are not within said first refrigeration units except that transport piping and the like which may be considered part of the second refrigeration circuit can pass into the first refrigeration units in order to provide heat exchange between the refrigerant of the first and second refrigeration circuits.

As used herein, the term "first refrigeration unit" and "low temperature refrigeration unit" means an at least partially closed or closable structure that is capable of providing cooling within at least a portion of that structure and which is structurally distinct from any structure enclosing or containing said second refrigeration circuit in its entirety. According to and consistent with such meanings, the preferred first refrigeration circuits and low temperature refrigeration circuits of the present invention are sometimes referred to herein as "self-contained" when contained within such first (preferably low temperature) refrigeration units, in accordance with the meanings described herein.

The second refrigeration circuit including in each of Systems 1-4, may further comprise a fluid receiver.

Each first refrigeration circuit including in each of Systems 1-4, may be self-contained within its respective refrigeration unit.

Each refrigeration unit including in each of Systems 1-4, may be located within a first area. The first area may be a shop floor. This means that each first refrigeration circuit (preferably low temperature refrigeration circuit) may also be located within a first area, such as a shop floor.

Each refrigeration unit including in each of Systems 1-4, may comprise a space and/or objects contained within a space to be chilled, and preferably that space is within the refrigeration unit. Each evaporator may be located to chill its respective space/objects, preferably by cooling air within the space to be chilled.

As mentioned above, the second refrigeration circuit of the present invention, including each of Systems 1-4, and preferably medium temperature refrigeration circuit, may have components thereof that extend between the first refrigeration unit (preferably low temperature refrigeration unit) and a second area. The second area may be, for example, a machine room which houses a substantial portion of the components of the second refrigeration circuit.

The second refrigeration circuit of the preset invention, including each of Sytems 1-4, (preferably medium temperature refrigeration unit) may extend to a second and a third area. The third area may be an area outside of the building or buildings in which the first refrigeration units and the second area(s) are located. This allows for ambient cooling to be exploited.

Unless otherwise indicated herein for a particular embodiment, the refrigerant in each of the first refrigeration circuits may be different from or the same as the other refrigerants in the first refrigeration circuits, and each may also be the same or different to the refrigerant in the second refrigeration circuit.

Unless otherwise indicated herein for a particular embodiment, the refrigerant in the first refrigeration circuits and/or the refrigerant in the second refrigeration circuit may have low Global Warming Potential (GWP).

Unless otherwise indicated herein for a particular embodiment, the refrigerant in the first refrigeration circuits and/or the refrigerant in the second refrigeration circuit may have a GWP which is less than 150. This is enabled by each first refrigeration circuit being provided in a respective refrigeration unit.

Unless otherwise indicated herein for a particular embodiment, the refrigerant in the second refrigeration circuit may be non-flammable, that is, classified as A1 under ASHRAE 34 (as measured by ASTM E681) or classified as A2L under ASHRAE 34 (as measured by ASTM E681). This may be desirable since the second refrigeration circuit may be quite long and may extend between different areas of a building: for example, between a shop floor (where refrigeration units might be deployed) to a machine room. Consequently, it may be unsafe to have a flammable refrigerant in the second refrigeration circuit since both the risk of leaks and the severity of potential leaks is increased as the second refrigeration circuit spans a greater area and therefore exposes more people and/or structures to risk of fire.

The refrigerant in the first refrigeration circuits may be flammable. This may be allowable in practice, at least in part, as a result of each first refrigeration circuit being provided in a respective refrigeration unit have a relatively low power compressor(s) contained therein.

Each first refrigeration circuit, including in each of Systems 1-4, may comprise at least one fluid expansion device. The at least one fluid expansion device may be a capillary tube or an orifice tube. This is enabled by the conditions imposed on each first refrigeration circuit by its respective refrigeration unit being relatively constant. This means that simpler flow control devices, such as capillary and orifice tubes, can be and preferably are used to advantage in the first refrigeration circuits.

The average temperature of each of the first refrigeration circuits, including in each of Systems 1-4, may be lower than the average temperature of the second refrigeration circuit. This is because the second refrigeration circuit may be used to provide cooling, that is, remove heat from, the first refrigeration circuits; and each first refrigeration circuit may cool a space to be chilled in its respective refrigeration unit.

The second refrigeration circuit may cool, that is, remove heat from, each of the first refrigeration circuits.

Each heat exchanger may be arranged to transfer heat energy between its respective first refrigeration circuit and the second refrigeration circuit at a respective circuit interface location.

The second refrigeration circuit, including in each of Systems 1-4, may comprise a second evaporator. The second evaporator may be coupled in parallel with the circuit interface locations.

Each of the circuit interface locations, including in each of Systems 1-4, may be coupled in series-parallel combination with each other of the circuit interface locations. Usefully, this means that if one of the circuit interface locations, first refrigeration circuits, or first refrigeration units has a fault or blockage detected, the location, circuit or unit at fault can be isolated and/or bypassed by the second refrigeration circuit so that faults do not propagate through the system.

Each of the circuit interface locations, including in each of Systems 1-4, may be coupled in series with at least one other circuit interface location.

Each of the circuit interface locations, including in each of Systems 1-4, may be coupled in series with each other of the circuit interface locations.

Each of the circuit interface locations, including in each of Systems 1-4, may be coupled in parallel with at least one other circuit interface location.

Each of the circuit interface locations, including in each of Systems 1-4, may be coupled in parallel with each other of the circuit interface locations.

The second refrigerant, preferably the medium temperature refrigerant, may comprise a blended refrigerant. The blended refrigerant may comprise one or more of R515A, R515B, FH, A1 (HDR-127) as defined herein, and A2 (HDR-128) as defined herein.

Each of refrigerants R515A, R515B, FH, A1 (HDR-127) and A2 (HDR-128) is non-flammable. This is useful since the second refrigerant circuit (preferably medium temperature refrigerant) may span numerous areas, and so having a non-flammable refrigerant is important for reducing the severity of potential leaks.

The present invention, including each of Systems 1-4, includes a second refrigerant that comprises, consists essentially of or consists of R515A.

The present invention, including each of Systems 1-4, includes a first refrigerant comprises, consists essentially of or consists of HFO-1234yf and said second refrigerant comprises R515A.

The present invention, including each of Systems 1-4, includes a first refrigerant comprises, consists essentially of or consists of R-455A and said second refrigerant comprises R515A.

The present invention, including each of Systems 1-4, includes a first refrigerant comprises, consists essentially of or consists of propane and said second refrigerant comprises R515A.

The present invention, including each of Systems 1-4, includes a second refrigerant that comprises, consists essentially of or consists of R515B.

The present invention, including each of Systems 1-4, includes a first refrigerant comprises, consists essentially of or consists of HFO-1234yf and said second refrigerant comprises R515B.

The present invention, including each of Systems 1-4, includes a first refrigerant comprises, consists essentially of or consists of R-455A and said second refrigerant comprises R515B.

The present invention, including each of Systems 1-4, includes a first refrigerant comprises, consists essentially of or consists of propane and said second refrigerant comprises R515B.

The present invention, including each of Systems 1-4, includes a second refrigerant that comprises, consists essentially of or consists of FH.

The present invention, including each of Systems 1-4, includes a first refrigerant comprises, consists essentially of or consists of HFO-1234yf and said second refrigerant comprises FH.

The present invention, including each of Systems 1-4, includes a first refrigerant comprises, consists essentially of or consists of R-455A and said second refrigerant comprises FH.

The present invention, including each of Systems 1-4, includes a first refrigerant comprises, consists essentially of or consists of propane and said second refrigerant comprises FH.

The present invention, including each of Systems 1-4, includes a second refrigerant that comprises, consists essentially of or consists of A1 (HDR-127).

The present invention, including each of Systems 1-4, includes a first refrigerant comprises, consists essentially of or consists of HFO-1234yf and said second refrigerant comprises A1 (HDR-127).

The present invention, including each of Systems 1-4, includes a first refrigerant comprises, consists essentially of or consists of R-455A and said second refrigerant comprises A1 (HDR-127).

The present invention, including each of Systems 1-4, includes a first refrigerant comprises, consists essentially of or consists of propane and said second refrigerant comprises A1 (HDR-127).

The present invention, including each of Systems 1-4, includes a second refrigerant that comprises, consists essentially of or consists of A2 (HDR-128).

The present invention, including each of Systems 1-4, includes a first refrigerant comprises, consists essentially of or consists of HFO-1234yf and said second refrigerant comprises A2 (HDR-128).

The present invention, including each of Systems 1-4, includes a first refrigerant comprises, consists essentially of or consists of R-455A and said second refrigerant comprises A2 (HDR-128).

The present invention, including each of Systems 1-4, includes a first refrigerant comprises, consists essentially of or consists of propane and said second refrigerant comprises A2 (HDR-128).

In other embodiments the non-flammable refrigerant may comprise, or comprise at least about 50%, or comprise at least 75%, or consist essentially of or consist of HFO-1233zd(E).

The first refrigerant (preferably low temperature refrigerant), which is used in the first refrigerant circuits (preferably low temperature refrigeration circuits), may comprise any of R744, C3-C4 hydrocarbons, R1234yf, R1234ze(E), R455A and combinations of these. Hydrocarbons may comprise any of propane (also known as R290), R600a or R1270. These refrigerants are low GWP. As is know to those skilled in the art R455A consists of about 75.5% by weight of R1234yf, about 21.5% by weight of R-32 and about 3% by weight of R744 (CO2).

The second refrigeration circuit may further comprise a compressor.

The second refrigeration circuit may comprise an ambient cooling branch and a compressor branch comprising the compressor. This means that the compressor branch may be bypassed. The benefit of bypassing the compressor branch is that, if the ambient conditions are sufficiently cool relative to the second refrigerant, the compressor stage can be bypassed as sufficient cooling is provided by the ambient air.

The ambient cooling branch may be coupled in parallel with the compressor branch. The parallel arrangement allows for the compressor branch to be bypassed by the second refrigerant.

The ambient cooling branch may be exposed to outside ambient temperatures. This is for cooling the second refrigerant in the place of the compressor stage.

The ambient cooling branch may extend to the outside of the building or buildings comprising the first area.

Refrigerant entering the ambient cooling branch may be cooled by the ambient air temperature when the ambient air temperature is less than the temperature of the refrigerant entering the ambient cooling branch.

The ambient cooling branch may be coupled in series with the pump.

A valve may be provided at one of both of the junctions between the ambient cooling branch and the compressor branch to control the flow of refrigerant in each of the ambient cooling branch and the compressor branch. This allows control of whether or not and how much the compressor branch and/or ambient cooling branch are utilised.

The pump, the further evaporator and the circuit interface locations may be located between the valve or valves.

BRIEF DESCRIPTION OF THE DRAWINGS

Exemplary arrangements of the disclosure shall now be described with reference to the drawings in which.

Throughout this specification, like reference numerals refer to like parts.

DETAILED DESCRIPTION

Comparative Example

Figure 1A:
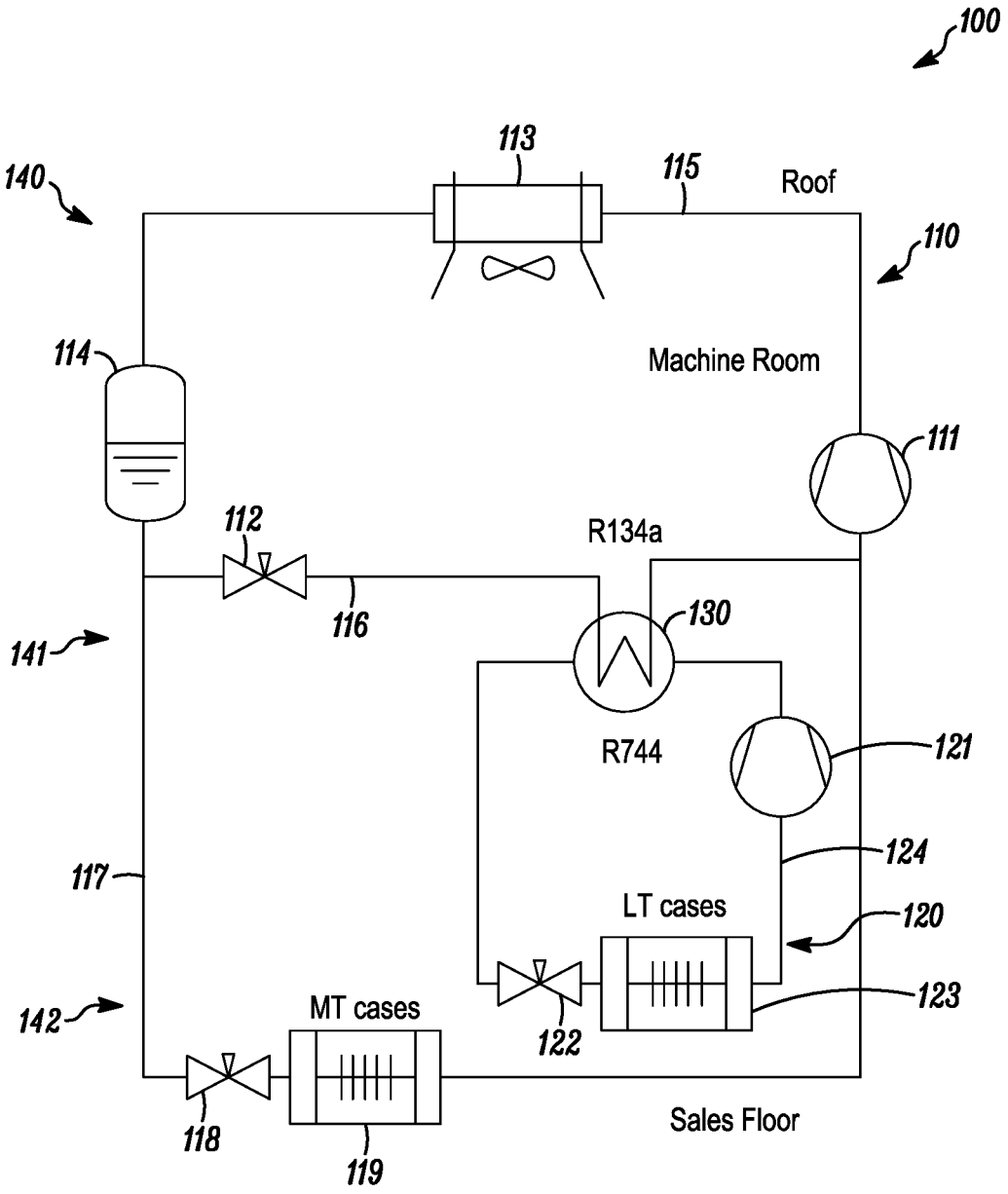
FIG. 1A shows an example of a previously used refrigeration system.

To aid the person skilled in the art's understanding of the refrigeration circuits of this disclosure and their respective advantages, a brief explanation of the functioning of a refrigeration system will be given in reference to the comparative refrigeration systems shown in FIGS. 1A and 1B.

Figure 1B:
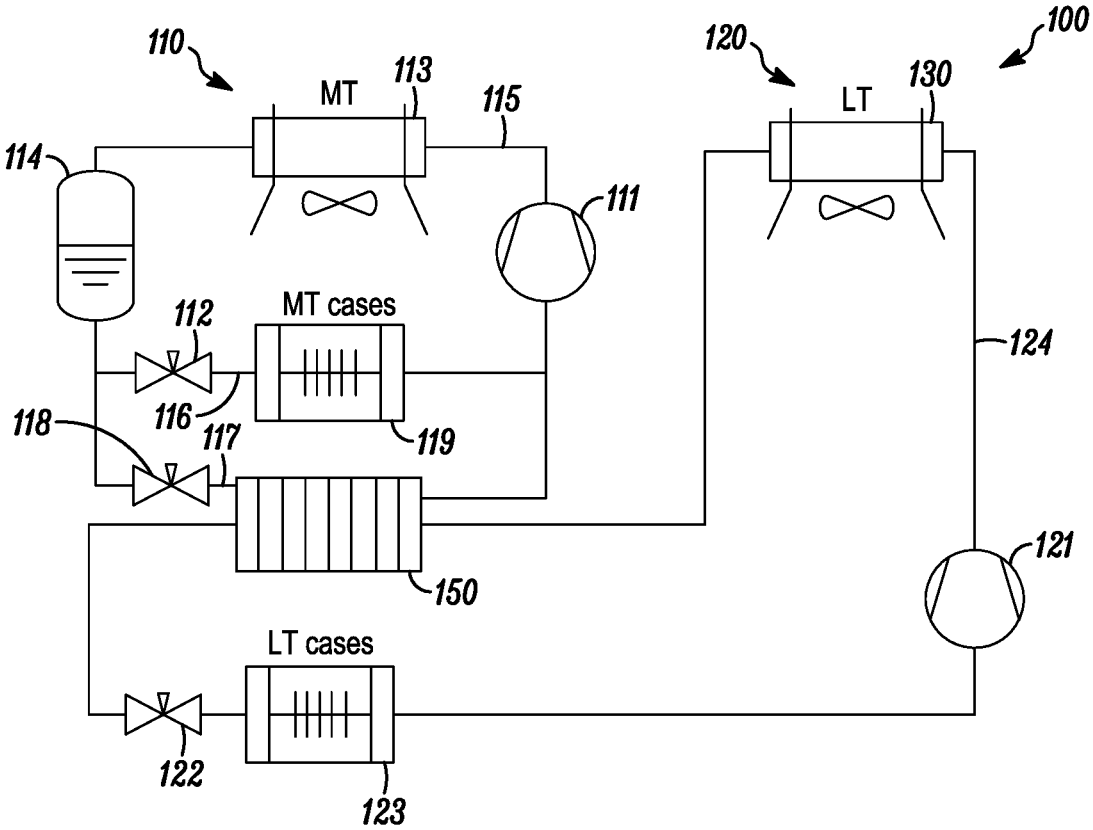
FIG. 1B shows an example of a refrigeration system that is the basis for the comparative examples described herein.

FIG. 1B shows an example of a refrigeration system 100 for comparison with the further systems described below. The system 100 comprises a medium temperature refrigeration circuit 110 and a low temperature refrigeration circuit 120.

The low temperature refrigeration circuit 120 has a compressor 121, an interface with a heat exchanger 130 for rejecting heat to ambient conditions, an expansion valve 122 and an evaporator 123. The low temperature refrigeration circuit 120 interfaces with the medium temperature refrigeration circuit 110 through the inter-circuit heat exchanger 150, which serves to reject heat to from the low temperature refrigerant to the medium temperature refrigerant and thereby produce a subcooled refrigerant liquid in the low temperature refrigerant cycle. The evaporator 123 is interfaced with a space to be chilled, such as the inside of a freezer compartment. The components of the low temperature refrigeration circuit are connected in the order: evaporator 123, compressor 121, heat exchanger 130, inter-circuit heat exchanger 150, and expansion valve 122. The components are connected together via pipes 124 containing a low temperature refrigerant.

The medium temperature refrigeration circuit 110 has a compressor 111, a condenser 113 for rejecting heat to ambient conditions and a fluid receiver 114. The liquid medium temperature refrigerant from receiver 114 is manifolded to flow to each of expansion valves 112 and 118, thus providing two parallel connected branches: a low temperature sub-cooling cooling branch 117 downstream of expansion device 118 and a medium temperature cooling branch 116 downstream of expansion device 112. The low temperature sub-cooling branch includes the inter-circuit heat exchanger which provides sub-cooling to the low temperature circuit as described above. The medium temperature cooling branch 116 includes medium temperature evaporator 119, which is interfaced with a space to be chilled, such as the inside of a refrigerated compartment.

The medium temperature refrigerant is a high GWP refrigerant such as R134a. R134A is a hydro fluorocarbon (HFC). R134a is non-flammable and provides a good coefficient of performance.

The system 100 spans three areas of a building: a roof where the condensers 113 and 130 are located; a machine room where the compressors 111, 112, heat exchanger 150, receiving tank 114 and expansion device 118 are located; and a sales floor 142 where the LT case, the MT case, and each of their expansion devices are located. The low temperature refrigeration circuit 120 and the medium temperature refrigeration circuit 110 thus each extend between the sales floor, the machine room and the roof. In use, the medium temperature circuit 110 provides medium temperature chilling to spaces to be chilled via the evaporator 119 and the low temperature circuit 120 provides low temperature chilling to spaces to be chilled via the evaporator 123. The medium temperature circuit 110 also removes heat from the liquid condensate from the low temperature condenser 120, thus providing subcooling to the liquid entering the evaporator 123.

The individual and overall functionality of the various components of the low temperature refrigeration circuit 120 will now be described. Starting with heat exchanger 150, heat exchanger 130 is a device suitable for transferring heat between the low and medium temperature refrigerants. In one example, the heat exchanger 150 is a shell and tube heat exchanger. Other types of heat exchangers, such as plate heat exchangers and other designs, may also be used. In use, the medium temperature refrigerant absorbs heat from the low temperature refrigerant such that the low temperature refrigerant is chilled. This removal of heat via the heat exchanger 150 results in the liquid low temperature refrigerant from condenser 130 being subcooled, after which the subcooled, low temperature refrigerant flows to the expansion valve 122 via a liquid line of the pipes 124. The role of the expansion valve 122 is to reduce the pressure of the low temperature refrigerant. By doing so, the temperature of the low temperature refrigerant is correspondingly reduced since pressure and temperature are proportional. The low temperature, low pressure refrigerant then flows or is pumped to the evaporator 123. The evaporator 123 is used to transfer heat from the space to be cooled, e.g., low temperature refrigeration cases in a super market, to the low temperature refrigerant. That is, at the evaporator 123, the liquid refrigerant accepts heat from the space to be chilled and, in doing so, is evaporated to a gas. After the evaporator 123, the gas is drawn by the compressor 121, through a suction line of the pipes 124, to the compressor 121. On reaching the compressor 121, the low pressure and low temperature gaseous refrigerant is compressed. This causes the refrigerant temperature to increase. Consequently, the refrigerant is converted from a low temperature and low pressure gas to a high temperature and high pressure gas. The high temperature and high pressure gas is released into a discharge pipe of the pipes 124 to travel to the heat exchanger (condenser) 130, where the gas is condensed to a liquid in the manner previously described. This describes the operation of the low temperature refrigeration circuit 120 specifically, however the principles explained here can be applied to refrigeration cycles, generally.

The individual and overall functionality of the various components of the medium temperature refrigeration circuit 110 will now be described. Starting with heat exchanger 150, as described above the medium temperature refrigerant absorbs heat from the low temperature refrigerant via the heat exchanger 150. This absorption of heat causes the refrigerant in the medium temperature circuit 150, which is a low temperature gas and/or a mixture of gas and liquid on entering the heat exchanger 150, to be change liquid to the gas phase and/or to increase the temperature of the gas in the case where superheating will be produced. On leaving the heat exchanger 150, the gaseous refrigerant is sucked into the compressor 111 (along with the refrigerant from the evaporator 119) and is compressed by the compressor 111 to a high temperature and high pressure gas. This gas is released into the pipes 115 and travels to the condenser 113 which, in this example, is located on a roof of a building. In the condenser 113, the gaseous medium temperature refrigerant releases heat to the outside ambient air and so is cooled and condenses to a liquid. After the condenser 113, the liquid refrigerant collects in a fluid receiver 114. In this example, the fluid receiver 114 is a tank. On leaving the fluid receiver 114, the liquid refrigerant is manifolded to parallel connected medium temperature branch 116 and subcooling cooling branch 117. In the medium temperature branch 116, the liquid refrigerant flows to the expansion valve 112 which is used to lower the pressure and therefore temperature of the liquid refrigerant. The relatively cold liquid refrigerant then enters the heat exchanger 119 where it absorbs heat from the space to be chilled which is interfaced with the evaporator 119*f*. In the subcooling branch 117, the liquid refrigerant similarly flows first to an expansion valve 118 where the pressure and temperature of the refrigerant is lowered. After the valve 118, the refrigerant flows to the inter-circuit heat exchanger 150, as described above. From there, the gaseous refrigerant from the heat exchanger is sucked by the compressor 111 to the compressor 111 where it re-joins the refrigerant from the medium temperature cooling branch 116.

Although not mentioned above, it will be clear that to function as intended, the temperature of the refrigerant in the medium temperature circuit 110 as it enters the heat exchanger 150 must be less than the temperature of the refrigerant in the low temperature circuit 120 as it enters the heat exchanger 150. If this were not the case, the medium temperature circuit 110 would not provide the desired subcooling to the low temperature refrigerant in circuit 120.

The above describes the operation of the comparative example of a refrigeration system 100 as illustrated in FIG. 1B. The principles of refrigeration described in reference to FIG. 1B can be applied equally well to the other refrigeration systems of this disclosure.

Overview of Preferred Embodiments

A number of refrigeration systems according to preferred embodiments of the present invention are described below. Each system has a number of refrigeration units and each of the refrigeration units has at least one dedicated refrigeration circuit located within it. That is, each refrigeration unit contains at least one refrigeration circuit.

The refrigeration circuit contained within a refrigeration unit may comprise at least a heat exchanger that removes heat to the refrigerant in the circuit, and an evaporator that adds heat to the refrigerant.

The refrigeration circuit contained within a refrigeration unit may comprise a compressor, at least a heat exchanger that removes heat from the refrigerant in the circuit (preferably by removing heat from the refrigerant vapor exiting the compressor), and an evaporator that adds heat to the refrigerant (preferably by cooling the area of the refrigeration unit being chilled). Applicants have found that the size of the compressor used in the preferred first refrigeration circuits (and preferably low temperature refrigeration circuits) of the present invention are important for achieving at least some of the highly advantageous and unexpected results of preferred embodiments of the present invention, and in particular, each compressor in in the circuit is preferably a small size compressor. As used herein, the term "small size compressor" means the compressor has a power rating of about 2 horsepower or less. As used herein with respect to compressor power rating, this value is determined by the input power rating for the compressor. As used with respect to compressor horse power rating, "about" means the indicated horse power +/−0.5 horse power. The compressor size in preferred embodiments may be from 0.1 horse power to about 2 horsepower, or from 0.1 horsepower to about 1 horse power. The compressor size may be from 0.1 horsepower up to 0.75 horsepower, or from 0.1 horsepower up to 0.5 horsepower.

A refrigeration unit may be an integrated physical entity, i.e. an entity which is not designed to be dismantled into component parts. A refrigeration unit might be a fridge or a freezer, for example. It will be understood that more than one refrigeration circuit (including particularly more than one low temperature refrigeration circuit) may be included within each refrigeration unit (including preferably each low temperature refrigeration unit).

The refrigeration circuits provided within each refrigeration unit may themselves be cooled by a common refrigeration circuit at least partially external to the refrigeration units. In contrast to the dedicated refrigeration circuits contained within each refrigeration unit, common refrigeration circuits (which are generally referred to herein as second and third refrigeration circuits) may be extended circuits which extend between multiple areas of the building housing the units: such as between a sales floor (where the refrigeration units are located) and a machine room and/or a roof or outside area.

Each refrigeration unit may comprise at least one compartment for storing goods, such as perishable goods. The compartments may define a space to be chilled by a refrigeration circuit contained within the refrigeration unit.

Cascaded Refrigeration System

One embodiment of a refrigeration system according to the present invention is illustrated schematically in FIG. 2 and described in detail below.

Figure 2:
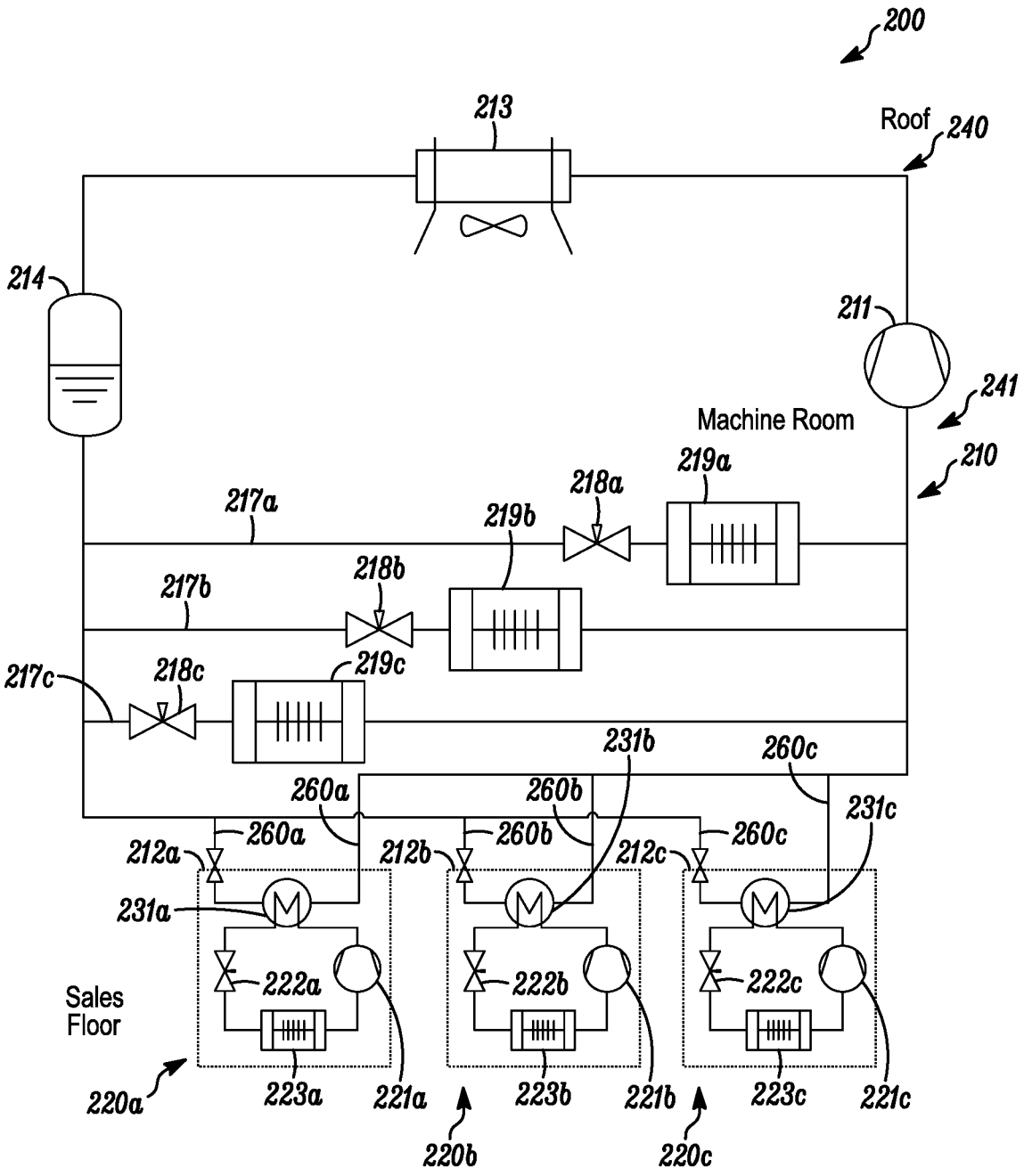
FIG. 2 shows a cascaded refrigeration system.

FIG. 2 shows a cascaded refrigeration system 200. More specifically, FIG. 2 shows a refrigeration system 200 which has three first refrigeration circuits 220*a*, 220*b* and 220*c*. Each of the first refrigeration circuits 220*a*, 220*b*, 220*c* has an evaporator 223, a compressor 221, a heat exchanger 230 and an expansion valve 222. While each of the compressors, evaporators and heat exchangers in the circuit are illustrated by a single icon, it will be appreciated that the compressor, the evaporator, the heat exchanger, expansion valve, etc can each comprise a plurality of such units. In each circuit 220*a*, 220*b* and 220*c*, the evaporator 223, the compressor 221, the heat exchanger 230 and the expansion valve 222 are connected in series with one another in the order listed. Each of the first refrigeration circuits 220*a*, 220*b* and 220*c* is included within a separate respective refrigeration unit (not shown). In this example, each of the three refrigeration units is a freezer unit and the freezer unit houses its respective first refrigeration circuit. In this way, each refrigeration unit comprises a self-contained and dedicated refrigeration circuit. The refrigeration units (not shown), and therefore the first refrigeration circuits 220*a*, 220*b*, 220*c*, are arranged on a sales floor 242 of a supermarket.

In this example, the refrigerant in each of the first refrigeration circuits 220*a*, 220*b*, 220*c* is a low GWP refrigerant such as R744, C3-C4 hydrocarbons (R290, R600a, R1270), R1234yf, R1234ze(E) or R455A. As the skilled person will appreciate, the refrigerants in each of the first refrigeration circuits 220*a*, 220*b*, 220*c* may the same or different to the refrigerants in each other of the first refrigeration circuits 220*a*, 220*b*, 220*c*.

The refrigeration system 200 also has a second refrigeration circuit 210. The second refrigeration circuit 210 has a compressor 211, a condenser 213 and a fluid receiver 214. The compressor 211, the condenser 213 and the fluid receiver 214 are connected in series and in the order given. While each of the compressors, condensers, fluid receivers, etc. in the second circuit are illustrated by a single icon, it will be appreciated that the compressor, the evaporator, the heat exchanger, expansion valve, etc can each comprise a plurality of such units. The second refrigeration circuit 210 also has four parallel connected branches: three medium temperature cooling branches 217*a*, 217*b* and 217*c*; and one low temperature cooling branch 216. The four parallel connected branches 217*a*, 217*b*, 217*c* and 216 are connected between the fluid receiver 214 and the compressor 211. Each of the medium temperature cooling branches 217*a*, 217*b* and 217*c* has an expansion valve 218*a*, 218*b* and 218*c* and an evaporator 219*a*, 219*b* and 219*c*, respectively. The expansion valve 218 and evaporator 219 are connected in series and in the order given between the fluid receiver 214 and the condenser 211. The low temperature cooling branch 216 has an expansion valve 212 and an interface, in the form of inlet and outlet piping, conduits, valves and the like (represented collectively as 260*a*, 260*b* and 260*c*, respectively) which bring the second refrigerant to and from each of the heat exchangers 230*a*, 230*b*, 230*c* of the first refrigeration circuits 220*a*, 220*b*, 220*c*. The low temperature cooling branch 216 interfaces each of the heat exchangers 230*a*, 230*b*, 230*c* of the first refrigeration circuits 220*a*, 220*b*, 220*c* at a respective circuit interface location 231*a*, 231*b*, 231*c*. Each circuit interface location 231*a*, 231*b*, 231*c* is arranged in series-parallel combination with each other of the circuit interface locations 231*a*, 231*b*, 231*c*.

The medium temperature refrigeration circuit 210 has components which extend between the sales floor 242, a machine room 241 and a roof 140. The low temperature cooling branch 216 and the medium temperature cooling branches 217*a*, 217*b*, 217*c* of the medium temperature refrigeration circuit 210 are located on the sales floor 242. The compressor 211 and the fluid receiver 214 are located in the machine room 241. The condenser 213 is located where it can be readily exposed to ambient conditions, such as on the roof 240.

In this example, the refrigerant in the medium temperature refrigeration circuit 210 is a blend comprising R515A. R515A is a refrigerant which consists essentially of, and preferably consists of, about 88% by weight of the hydrofluoroolefin (HFO) 1234ze(E) and about 12% of HFC227ea (heptafluoropropane). Usefully, the blend results in a non-flammable refrigerant, which improves safety. Further advantageously, the blend has a low GWP, making it an environmentally friendly solution.

Use of the preferred embodiments as illustrated in FIG. 2 can be summarized as follows:

- each of the first refrigeration circuits 220*a*, 220*b*, 220*c* absorbs heat via their evaporators 223 to provide low temperature cooling to a space to be chilled (not shown);
- the second refrigeration circuit 210 absorbs heat from each of the heat exchangers 230*a*, 230*b*, 230*c* to cool the first refrigeration circuits 220*a*, 220*b*, 220*c;*
- the second refrigeration circuit 210 absorbs heat at each of the evaporators 219 to provide medium temperature cooling to spaces to be chilled (not shown); and
- heat is removed from the refrigerant in the second refrigeration circuit 210 in the chiller 213.

A number of beneficial results can be achieved using arrangements of the present invention of the type shown in FIG. 2, particularly from each first refrigeration circuit 230 being self-contained in a respective refrigeration unit.

For example, installation and uninstallation of the refrigeration units and the overall cascaded refrigeration system 200 is simplified. This is because the refrigeration units, with their built-in, self-contained first refrigeration circuits 220*a*, 220*b*, 220*c*, can be easily connected or disconnected with the second refrigeration circuit 210, with no modification to the first refrigeration circuit 220, 220*b*, 220*c* required. In other words, the refrigeration units may simply be 'plugged' in to, or out of, the second refrigeration circuit 210.

Another advantage is that each refrigeration unit, including its respective first refrigeration circuit 220*a*, 220*b*, 220*c*, can be factory tested for defaults before being installed into a live refrigeration system 200. This mitigates the likelihood of faults, which can include leaks of potentially harmful refrigerants. Accordingly, reduced leak rate can be achieved.

Another advantage is that the lengths of the first refrigeration circuits 220*a*, 220*b*, 220*c* can be reduced since each circuit 220*a*, 220*b*, 220*c* is arranged in its respective refrigeration unit, and does not extend between a series of units. The reduced circuit length can result in improved efficiency as there is reduced heat infiltration in shorter lines due to reduced surface area. Further, reduced circuit length can also result in reduced pressure drop, which improves the system 200 efficiency.

The reduced circuit length, and the provision of the circuits self-contained within respective refrigeration units, also provides the ability to use more flammable refrigerants in the first circuit of the present invention, including in each of Systems 1-4, such as R1234yf, hydrocarbons (including particulary propane (R290)), or R455A, which applicants have come to appreciate is a highly beneficial result. This is because both the likelihood of the refrigerant leaking is reduced (as discussed above) and because, even if the refrigerant were to leak, the leak would be contained to the relatively small area and containable area of the respective refrigeration unit, and because of the small size of the units, only a relatively small amount of refrigerant charge is used. In addition, this arrangement would permit the use of relatively low cost flame mitigation contingency procedures and/or devices since the area containing potentially flammable materials is much smaller, confined and uniform. Such more flammable refrigerants can have lower global warming potential (GWP). Advantageously therefore, governmental and societal targets for the use of low GWP refrigerants may be met and potentially even exceeded without compromising on safety of the system.

Another advantage is that each first refrigeration circuit 220*a*, 220*b*, 220*c* may only cool their respective refrigeration unit. This means that the load on each first refrigeration circuit 220*a*, 220*b*, 220*c* may remain relatively constant. That is, constant conditions are applied to the condensing 231 and evaporating 223 stages of the first refrigeration circuit 220. This allows for the simplification of the design of the first refrigeration circuit 220 in that passive expansion devices 222, such as capillary tubes or orifice tubes, can be used. This is in contrast to more complex circuits where electronic expansion devices and thermostatic expansion valves need to be used. Since the use of such complex devices is avoided, costs can be reduced and reliability can be increased.

Furthermore, importantly, the provision of a flooded heat exchanger in the second refrigeration circuit according to such embodiments, including each of Systems 1-4, results in improved heat transfer between the first and second circuits. Accordingly, the efficiency of the overall refrigeration system is improved.

There are several advantages that may arise from circuit interface locations being coupled in parallel with other circuit interface locations. One advantage may be that resilience is provided in the system since a fault associated with or suffered at one circuit interface location will not impact other circuit interface locations. This is because each circuit interface location is serviced by a respective branch of the second refrigeration circuit. Another advantage may be that heat transfer efficiency between first and second refrigeration circuits is improved because the temperature of the second refrigerant before each circuit interface location can be kept relatively constant. In contrast, if two circuit interface locations were coupled in series, the temperature of the refrigerant in the second refrigeration circuit may be higher before the downstream circuit interface location, than before the upstream circuit interface location.

Overall, the provision of a plurality of first refrigeration circuits according to the present invention, including each of Systems 1-4, with each one arranged in a respective refrigeration unit, preferably being arranged as a self-contained refrigeration circuit, has such benefits as: reducing leak rates; simplifying the overall refrigeration system; enabling the use of otherwise unsafe low GWP refrigerants; improving maintenance and installation; and reducing pressure drop, leading to improved system efficiency.

In preferred embodiments, including each of Systems 1-4, the present invention also includes a cascaded refrigeration system, comprising: a plurality of low temperature refrigeration circuits, with each low temperature refrigeration circuit comprising a flammable low temperature refrigerant having a GWP of about 150 or less and comprising at least about 50% by weight, or at least about 75% by weight, or at least 95% by weight, or at least 99% by weight of propane (R290), R1234yf, R455A and combinations of these, a compressor having a work output of about 3.5 kilowatts or less, a heat exchanger in which said low temperature refrigerant condenses in the range of temperatures of from about −5° C. to about −15° C.; and a medium temperature refrigeration circuit containing medium temperature refrigerant, wherein said medium temperature refrigerant is non-flammable having a GWP of up to about 500 and comprising at least about 50% by weight, or at least about 75% by weight, or at least 85% by weight of R515A, R515B, FH, A1, A2 and combinations of these, and an evaporator in which said medium temperature refrigerant evaporates at a temperature below said low temperature refrigerant condensing temperature and in the range of about −5° C. to about −15° C., wherein said medium temperature refrigerant evaporates in said heat exchanger by absorbing heat from said low temperature refrigerant.

In preferred embodiments, including each of Systems 1-4, the present invention also includes a cascaded refrigeration system, comprising: a plurality of low temperature refrigeration circuits, with each low temperature refrigeration circuit comprising a flammable low temperature refrigerant having a GWP of about 150 or less and comprising at least about 50% by weight, or at least about 75% by weight, or at least 95% by weight, or at least 99% by weight of propane (R290), R1234yf, R455A and combinations of these, a compressor having a horsepower rating of 2 horsepower or less, a heat exchanger in which said low temperature refrigerant condenses in the range of temperatures of from about −5° C. to about −15° C.; and a medium temperature refrigeration circuit containing medium temperature refrigerant, wherein said medium temperature refrigerant is non-flammable having a GWP of up to about 500 and comprising at least about 50% by weight, or at least about 75% by weight, or at least 85% by weight of R515A, R515B, FH, A1, A2 and combinations of these, and an evaporator in which said medium temperature refrigerant evaporates at a temperature below said low temperature refrigerant condensing temperature and in the range of about −5° C. to about −15° C., wherein said medium temperature refrigerant evaporates in said heat exchanger by absorbing heat from said low temperature refrigerant.

Cascaded Refrigeration System—Alternatives

As the person skilled in the art will appreciate in view of the teachings contained here, there may be in accordance with the present invention, including each of Systems 1-4, any number of first refrigeration circuits 220. In particular, there may be as many first refrigeration circuits 220 as there are refrigeration units to be cooled. Accordingly, the second refrigeration circuit 210 may be interfaced with any number of first refrigeration circuits 220.

As will be clear to the skilled person in view of the teachings contained here, there may be in accordance with the present invention, including each of Systems 1-4, any number and arrangement of medium temperature cooling branches 217 and evaporators 218.

Figure 3:
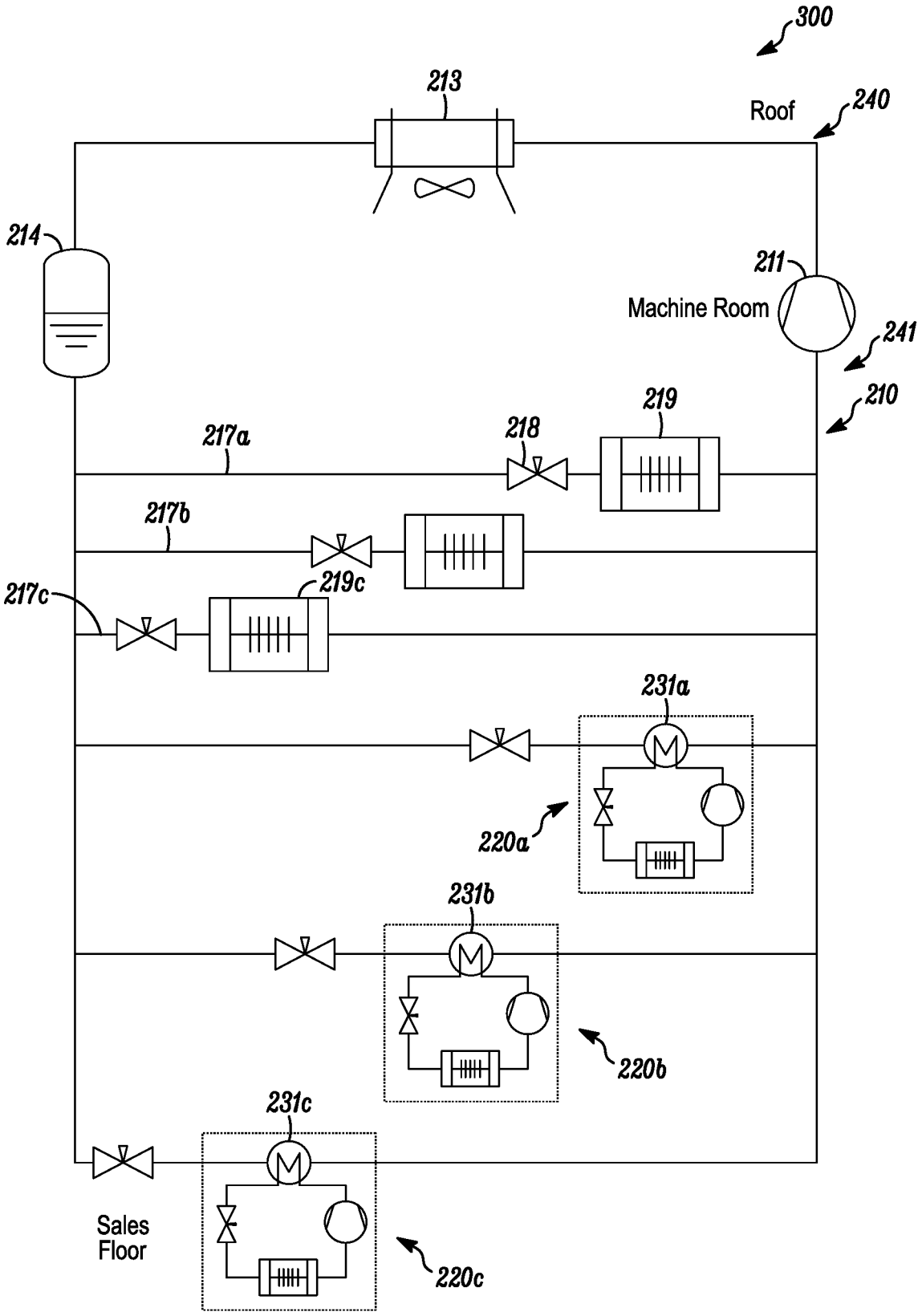
FIG. 3 shows an alternative cascaded refrigeration system.

In alternative arrangements in accordance with the present invention, including each of Systems 1-4, each first refrigeration circuit 220 may be arranged fully in parallel with each other first refrigeration circuit 220. An example of such an arrangement is shown in FIG. 3. FIG. 3 shows a system 300 where each circuit interface location 231*a*, 231*b*, 231*c* is arranged fully in parallel with each other circuit interface location 231*a*, 231*b*, 231*c*. The components of the system 300 are otherwise the same as in system 200 (described in reference to FIG. 2), and components of the system 300 function in substantially the same way as the system 200, although it will be appreciated that the performance of the overall system and other important features of the overall system can be significantly impacted by this change in the arrangement.

Usefully, this means that a given portion of refrigerant from the second refrigeration circuit 210 only passes through one heat exchanger 230 before it is returned to the compressor 211. This arrangement thus ensures that each of the heat exchangers 230 will receive second refrigerant at about the same temperature, since the arrangement prevents any of the heat exchanger from receiving a portion of the refrigerant that is pre-warmed as a result of passing through an upstream heat exchanger, as would be the case in a series arrangement.

As will be clear to the person skilled in the art in view of the teachings contained here, many other arrangements of the circuit interface locations 231*a*, 231*b*, 231*c* with respect to one and the second refrigeration circuit 210 can be achieved in accordance with the present invention, including each of Systems 1-4, and indeed are envisaged.

As will be clear to the person skilled in the art in view of the teachings contained here, by virtue of the preferred modular first refrigeration circuit design the refrigeration system of the preferred embodiments of the present invention, including each of Systems 1-4, allows use of non-flammable, low-pressure refrigerants with relatively low GWP in the second refrigeration circuit 210. Further, the preferred systems of the present invention, including each of Systems 1-4, produce the unexpected result of relatively safe and efficient use of flammable, low-pressure refrigerants with low GWP in the first refrigeration circuits, thereby providing a refrigeration system of reduced environmental impact and have excellent environmental properties, excellent safety features and improved system efficiency.

Cascaded Refrigeration System with Flooded Evaporator

A preferred refrigeration system of the present invention is exemplified and will be now be described with reference to FIG. 4.

Figure 4:
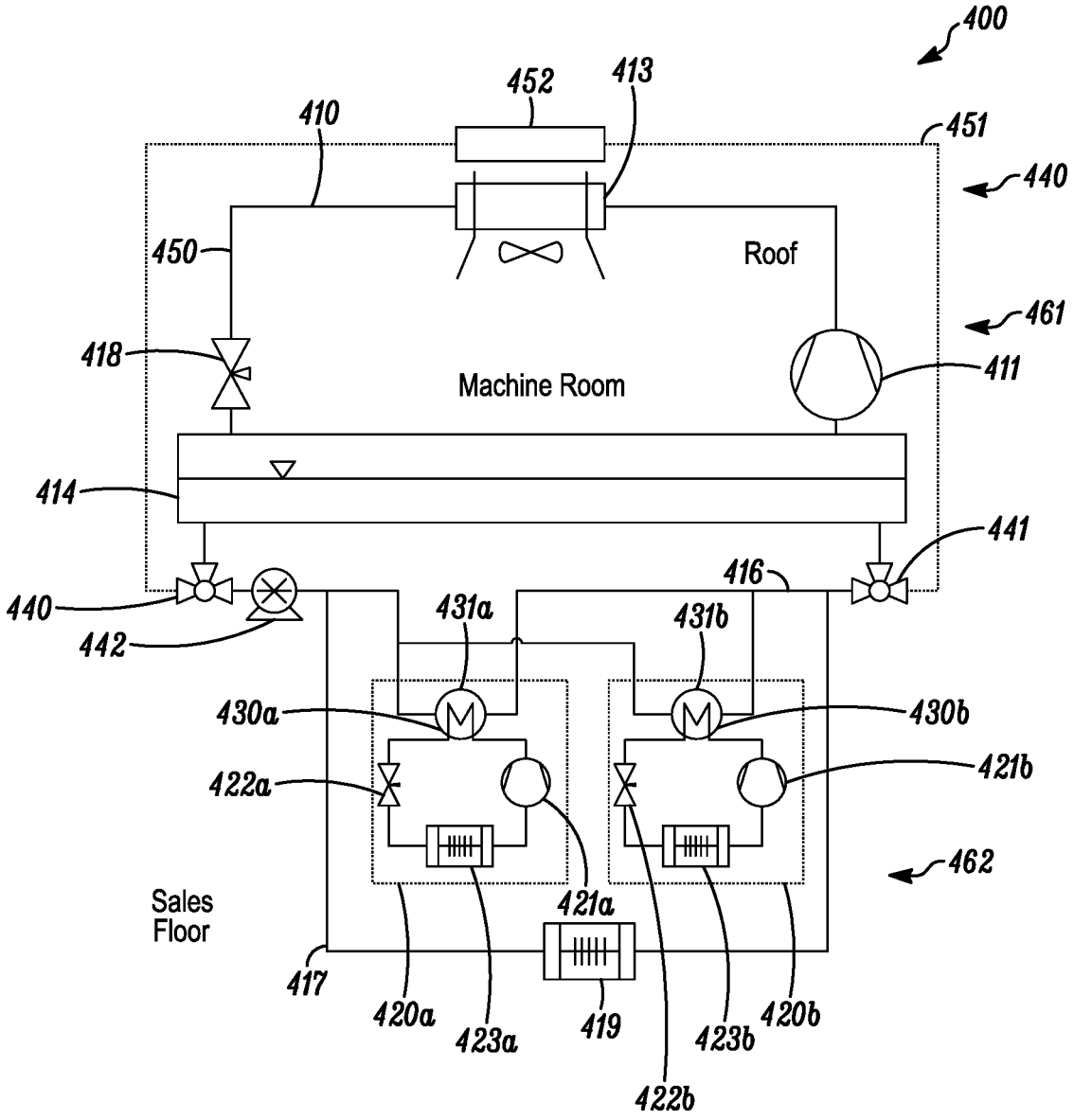
FIG. 4 shows a cascaded refrigeration system which uses a flooded evaporator.

FIG. 4 schematically shows a cascaded refrigeration system 400 with a second refrigeration circuit 410 that has a receiver that delivers liquid second refrigerant, which results in flooded evaporator operation in the first refrigeration circuit. More specifically, FIG. 4 shows a refrigeration system 400 which has two first refrigeration circuits 420*a*, 420*b*. Each of the first refrigeration circuits 420*a*, 420*b* has an evaporator 423, a compressor 421, a heat exchanger 430 and an expansion valve 422. In each circuit 420*a*, 420*b*, the evaporator 423, the compressor 421, the heat exchanger 430 and the expansion valve 422 are connected in series with one another in the order listed. Each of the first refrigeration circuits 420*a*, 420*b* is provided in a respective refrigeration unit (not shown). In this example, each refrigeration unit is a freezer unit and the freezer unit houses its respective first refrigeration circuit. In this way, a self-contained and dedicated refrigeration circuit is provided to each refrigeration unit. The refrigeration units (not shown), and therefore the first refrigeration circuits 420*a*, 420*b* are located on a sales floor 462 of a supermarket.

In this example, the refrigerant in the first refrigeration circuits 420*a*, 420*b*, is a low GWP refrigerant such as hydrocarbons (including preferably propane (R290), R1234yf or R455A. As the skilled person will appreciate, the refrigerants in each of the first refrigeration circuits 420*a*, 420*b* may the same or different to the refrigerants in the other of the first refrigeration circuits 420*a*, 420*b*.

The refrigeration system 400 also has a second refrigeration circuit 410. The second refrigeration circuit 410 has a compressor branch 450 and an ambient cooling branch 451. The compressor branch 450 is connected in parallel with the ambient cooling branch 451.

The compressor branch 450 has a compressor 411, a condenser 413, an expansion valve 418 and a receiver 414. The compressor 411, the condenser 413 and the expansion valve 418 are connected in series and in the order given. The receiver 414 is connected between the compressor 411 inlet and the expansion valve 418 outlet. The ambient cooling branch 451 has a chiller 452.

The compressor branch 450 and the ambient cooling branch 451 are connected in parallel by first 440 and second 441 controllable valves. The controllable valves 440, 441 are controllable such that the amount of refrigerant flowing in each of the compressor branch 450 and the ambient cooling branch 451 is controllable. The first control valve 440 is connected in series with a pump 442.

The second refrigeration circuit 410 also has two further branches which are connected in parallel with one another: a medium temperature cooling branch 417 and a low temperature cooling branch 416. The medium temperature cooling branch 417 and the low temperature cooling branch 416 are connected between the pump 442 and the second controllable valve 441.

The medium temperature cooling branch 417 has an evaporator 419. The low temperature cooling branch 416 interfaces each of the heat exchangers 430*a*, 430*b* of the first refrigeration circuits 420*a*, 420*b* at a respective circuit interface location 431*a*, 431*b*. Each of the circuit interface locations 431*a*, 431*b* is in series-parallel combination with the other circuit interface location 431*a*, 431*b*.

The second refrigeration circuit 410 includes components that extend the circuit between the sales floor 462, a machine room 461 and a roof 440. The low temperature cooling branch 416 and the medium temperature cooling branch 417 of the medium temperature refrigeration circuit 410 are preferably located primarily on the sales floor 462. By primarily arranged on the sales floor 462, it is meant that the circuit locations 431*a*, 431*b* and the evaporator 419 are arranged on or very near the sales floor 462. The junction between the low 416 and medium 417 temperature cooling branches and some of the pipes of the low 416 and medium 417 branches are however located in the machine room 461.

The compressor branch 450 includes components that extend the branch between the machine room 461 and the roof 460. More specifically, the compressor 411, the expansion valve 418 and the flooded receiver 414 are located in the machine room 461. The condenser 413 is located where ready access to ambient air is possible, such as on the roof 460.

The ambient cooling branch 450 includes components that extend the branch between the machine room 461 and the roof 460. The chiller 452 is also located where ready access to ambient air is possible, such as on the roof 603.

The first and second controllable valves 440, 441 are located in the machine room 461. The pump 442 is located in the machine room 442.

In this example, the refrigerant in the second refrigeration circuit 410 is a R515A, as described above.

Though structurally different, in use, the refrigeration system 400 operates in a similar manner to refrigeration system 200 with the following key differences.

Firstly, the receiver in the second refrigeration circuit 410 in the refrigeration system 400 results in evaporators 419, 430*a* and 430*b* being flooded evaporator, that is, the refrigerant enters the evaporator as a liquid, and some portion of the liquid refrigerant is not fully vaporised to a gas, which means that essentially no superheating occurs in the evaporator. How much of the refrigerant remains liquid is dependent on the working conditions of the system 400. One feature of the refrigeration system 400 is the receiver 414. The receiver 414 is arranged to separate the gaseous and liquid refrigerant after it has passed through the expansion valve 418 such that the refrigerant allowed through to the medium 417 and low 416 temperature cooling branches—and therefore through to the evaporator 419 and heat exchangers 430*a*, 430*b*—is essentially 100% liquid. Another key feature of the refrigeration system 400 is the pump 442. The pump 442 drives the refrigerant to the medium 417 and low 416 temperature branches. In alternative system arrangements, the density difference between the liquid and gaseous phases of the refrigerant drives the system and no pump or fan is required.

As the skilled person will appreciate based on the disclosure and teaching contained herein, there are several advantages associated with using a refrigeration arrangement in accordance with the present invention, including each of Systems 1-4, which uses a flooded evaporator, as disclosed for example in system 400. Applicants have found that one such advantage is and unexpected improvement in the coefficient of performance (COP). Without necessarily being bound to any particular theory, it is believed that this advantage, which is unexpected, arises in part because less compressor 411 work is required and the cooling capacity of the second refrigeration circuit 410 is improved because the system allows operation with superheating the refrigerant before it enters the compressor.

A second difference in the way the refrigeration system 400 operates compared to the refrigeration system 200 lies in the provision of the ambient cooling branch 451 and controllable valves 440, 441. The ambient cooling branch 451 allows the compressor branch 450 to be bypassed when the ambient temperature is sufficiently low to chill the refrigerant. This is achieved by routing the ambient cooling branch 451 to the roof 460 to provide maximum exposure of the refrigerant to the ambient air temperature. This is sometimes called winter operation. Usefully, this provides essentially free chilling of the refrigerant in the second refrigeration circuit 410. Clearly this is advantageous both from a cost and environmental perspective as energy consumption is greatly reduced as compared to running the compressor branch 450.

For the purposes of convenience, the term "flooded system," "flooded cascade system," and the like refer to systems of the present disclosure in which at least one and preferably all of the heat exchangers in the first refrigeration circuit (preferably low temperature circuit) for condensing said first refrigerant (preferably low temperature refrigerant) are flooded evaporators for the second refrigerant (preferably the medium temperature refrigerant). In preferred embodiments in accordance with the present invention, including each of Systems 1-4, the medium temperature evaporator is also a flooded evaporator. The potential advantages described in reference to the cascaded refrigeration system apply equally well to the flooded cascaded refrigeration system: the terms used to describe the flooded and non-flooded cascaded refrigeration system being comparable.

Further advantages of the flooded cascaded refrigeration system in accordance with the present invention, including each of Systems 1-4, can include: reduced energy consumption due to exploitation of the ambient cooling branch (winter operation); improved heat transfer performance in the heat exchangers and evaporators due to their flooded operation; no thermostatic expansion valves are required due to the provision of a pump in the circuit; and low cost materials can be used to manufacture the second refrigeration circuit due to it being suitable for low pressure refrigerant.

Particularly in view of the advantages described herein, the present invention including each of Systems 1-4, includes a cascaded refrigeration system, comprising: a plurality of first refrigeration circuits, with each first refrigeration circuit comprising a first refrigerant which is flammable and which has a GWP of about 150 or less, a compressor having a horse power rating of about 2 horse power or less, and a heat exchanger in which said first refrigerant condenses; and a second refrigeration circuit containing a second refrigerant which is non-flammable, and a flooded evaporator in which said second refrigerant evaporates at a temperature below said first refrigerant condensing temperature wherein said second refrigerant evaporates in said heat exchanger by absorbing heat from said first refrigerant.

Particularly in view of the advantages described herein, the present invention, including each of Systems 1-4, also includes a cascaded refrigeration system, comprising: a plurality of first refrigeration circuits, with each first refrigeration circuit comprising a first refrigerant which is flammable and which has a GWP of about 150 or less, a compressor having a horse power rating of about 2 horse power or less, and a heat exchanger in which said first refrigerant condenses; and a second refrigeration circuit containing a second refrigerant which is non-flammable and which has a GWP of up to about 500, and a flooded evaporator in which said second refrigerant evaporates at a temperature below said first refrigerant condensing temperature wherein said second refrigerant evaporates in said heat exchanger by absorbing heat from said first refrigerant.

The present invention includes a cascaded refrigeration system, including each of Systems 1-4, comprising: a plurality of low temperature refrigeration circuits, with each first low temperature refrigeration circuit comprising a flammable first refrigerant and having a GWP of about 150 or less, a compressor having a horse power rating of about 2 horse power or less, a heat exchanger in which said first refrigerant condenses in the range of temperatures of from about −5° C. to about −15° C.; and a medium temperature refrigeration circuit containing a non-flammable medium temperature refrigerant, and a flooded evaporator in which said medium temperature refrigerant evaporates at a temperature below said low temperature refrigerant condensing temperature and in the range of about −5° C. to about −15° C., wherein said medium temperature refrigerant evaporates in said heat exchanger by absorbing heat from said low temperature refrigerant.

The present invention includes a cascaded refrigeration system, including each of Systems 1-4, comprising: a plurality of low temperature refrigeration circuits, with each first low temperature refrigeration circuit comprising a flammable first refrigerant and having a GWP of about 150 or less, a compressor having a horse power rating of about 2 horse power or less, a heat exchanger in which said first refrigerant condenses in the range of temperatures of from about −5° C. to about −15° C.; and a medium temperature refrigeration circuit containing a non-flammable medium temperature refrigerant having a GWP of up to about 500, and a flooded evaporator in which said medium temperature refrigerant evaporates at a temperature below said low temperature refrigerant condensing temperature and in the range of about −5° C. to about −15° C., wherein said medium temperature refrigerant evaporates in said heat exchanger by absorbing heat from said low temperature refrigerant.

In preferred embodiments, the present invention also includes a cascaded refrigeration system, including each of Systems 1-4, comprising: a plurality of low temperature refrigeration circuits, with each low temperature refrigeration circuit comprising a flammable low temperature refrigerant having a GWP of about 150 or less and comprising at least about 50% by weight, or at least about 75% by weight, or at least 95% by weight, or at least 99% by weight of propane (R290), R1234yf, R455A and combinations of these, a compressor having a horse power rating of about 2 horse power or less, a heat exchanger in which said low temperature refrigerant condenses in the range of temperatures of from about −5° C. to about −15° C.; and a medium temperature refrigeration circuit containing medium temperature refrigerant, wherein said medium temperature refrigerant is non-flammable and selected from R515A, R515B, FH, A1 (HDR-127) and A2 (HDR-128), and a flooded evaporator in which said medium temperature refrigerant evaporates at a temperature below said low temperature refrigerant condensing temperature and in the range of about −5° C. to about −15° C., wherein said medium temperature refrigerant evaporates in said heat exchanger by absorbing heat from said low temperature refrigerant.

Flooded Cascaded Refrigeration System—Alternatives

The alternatives described above in reference to the cascaded refrigeration system apply equally well to the flooded cascaded refrigeration system: the terms first and second refrigeration circuit, circuit interface location and heat exchanger being comparable. Other alternatives include removal of the ambient cooling branch 451 and/or reversion of the flooded system to a direct expansion system.

A yet further alteration of the system 400, including each of Systems 1-4, which is envisaged is that the ambient cooling branch 451 may be shortened and simplified such that it only bypasses the compressor 411, rather than the entire compressor branch. This arrangement is shown in FIG. 4A.

Figure 4A:
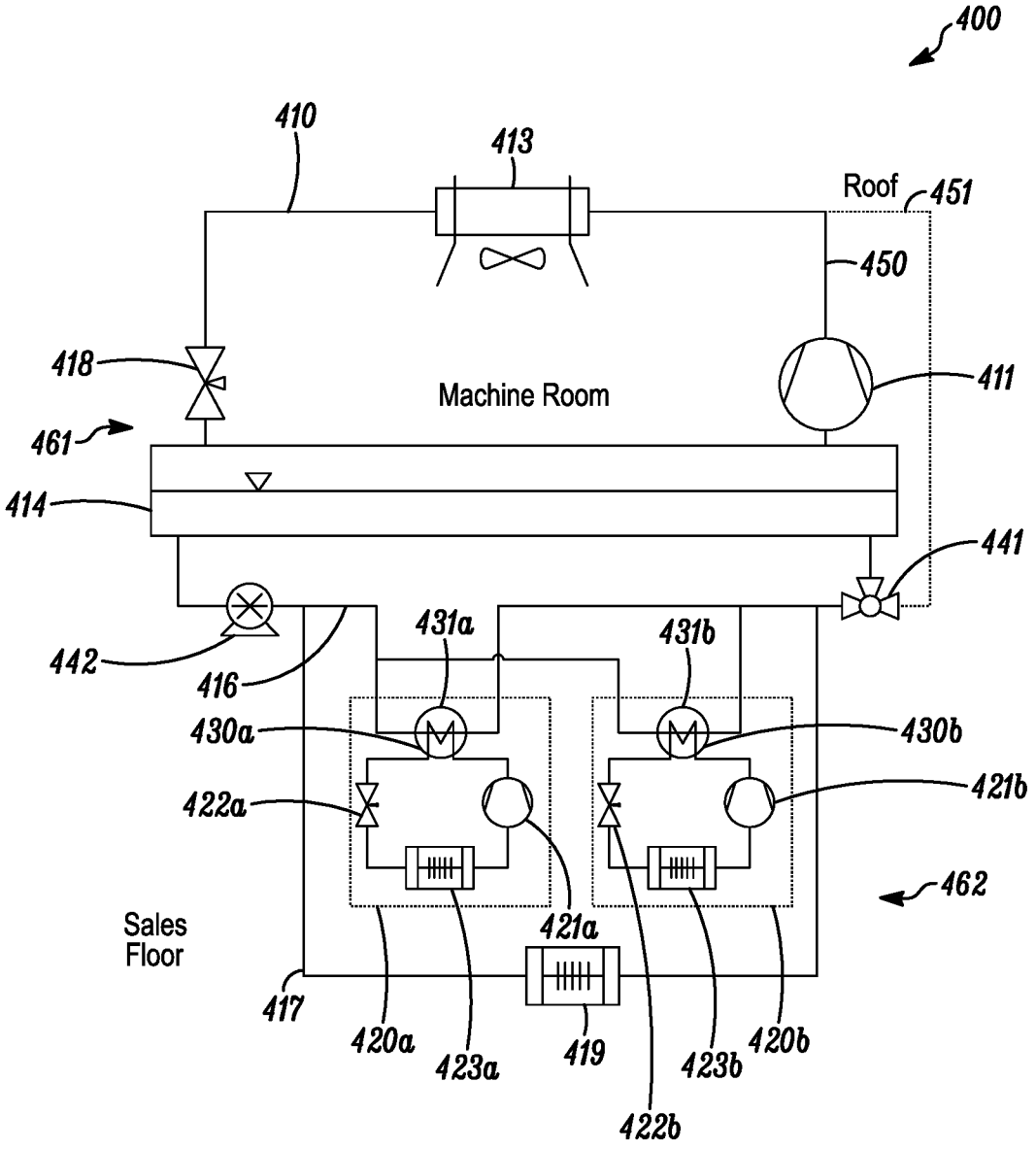
FIG. 4A shows an alternative cascaded refrigeration system which uses a flooded evaporator.

FIG. 4A shows a refrigeration system 400 which is the largely the same as that described in reference to FIG. 4 with the following exceptions:

The chiller 452 of FIG. 4 is not present as it is no longer required. This is because the ambient cooling branch 451 no longer bypasses the chiller 413 and so it does not require its own dedicated chiller.

The first controllable valve 440 is not present as it is no longer required. This is because the refrigerant from the ambient cooling branch 451 simply feeds into the chiller 413 line, rather than meeting a junction of branches.

The ambient cooling branch 451 is connected in parallel with the compressor 411 between the second controllable valve 441 and the line between the compressor 411 and the chiller 413.

Advantageously, the use of a shortened ambient chilling branch, that is, one in which the branch routes liquid refrigerant from receiver outlet to the condenser inlet results in: first, a simplified circuit as the chiller and first controllable valve at the inlet of the receiver pump are no longer required; and second, a lower cost circuit, since the amount of extra piping for the ambient chilling branch and the number of components is reduced, therefore reducing material costs.

As will be clear to the person skilled in the art in view of the teachings contained here, by virtue of the preferred modular first refrigeration circuit design the refrigeration system of the preferred embodiments of the present invention including each of Systems 1-4, allows use of non-flammable, low-pressure refrigerants with relatively low GWP in the second refrigeration circuit. Further, the system 400 allows use of flammable, low-pressure refrigerants with low GWP in the first refrigeration circuits. Further still, by virtue of the use of an ambient cooling branch, the system provides reduced energy usage. Yet further still, by virtue of its flooded design, the system delivers improved system efficiencies. Accordingly, a refrigeration system of reduced environmental impact is provided through use of reduced GWP refrigerants, reduced energy usage and improved system efficiency.

Suction Line Heat Exchanger

A further possible alteration of any of the systems forming part of this disclosure including each of Systems 1-4, is that any number of the self-contained refrigeration circuits may include a suction line heat exchanger (SLHX).

More specifically, any of the first refrigeration circuits 220*a*, 220*b*, 220*c* in system 200, including each of Systems 1-4, may include an SLHX; and any of the first refrigeration circuits 420*a*, 420*b* may include an SLHX. For comparison, FIG. 5A shows a refrigeration circuit 700 without a SLHX; while FIG. 5B shows a refrigeration circuit 750 with a SLHX 760.

Figure 5A:
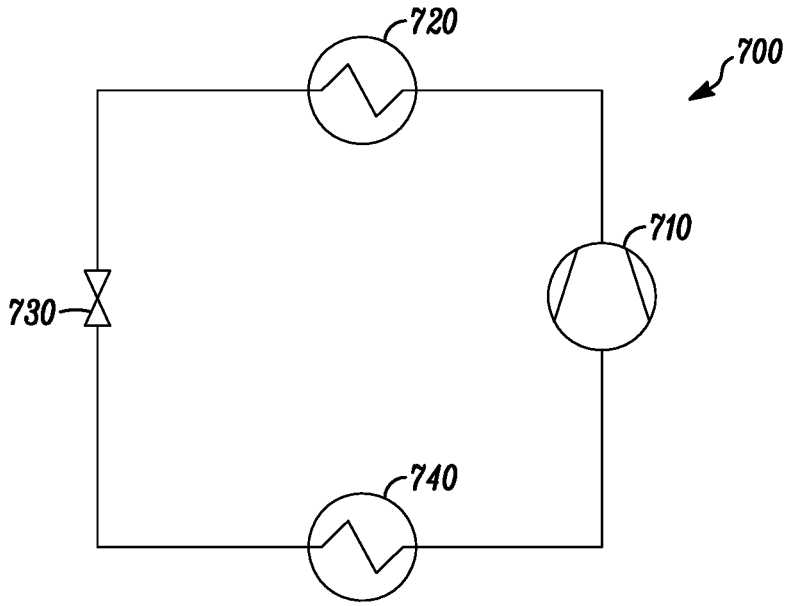
FIGS. 5A and 5B show refrigeration systems with and without suction line heat exchangers, respectively.

The circuit 700 in FIG. 5A has a compressor 710, a heat exchanger 720, an expansion valve 730 and an evaporator 740. The compressor 710, the heat exchanger 720, the expansion valve 730 and the evaporator 740 are connected in series and in the order listed. In use, the refrigeration circuit 700 functions as previously described.

Figure 5B:
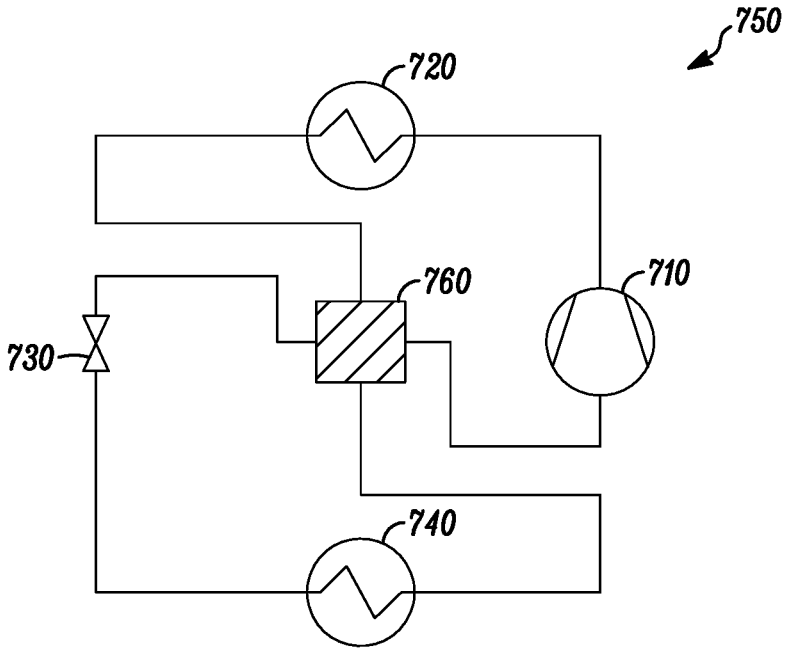

The circuit 750 in FIG. 5B has the same components as the circuit 700, plus an additional SLHX 760. The SLHX provides a heat exchanging interface between the line connecting the evaporator 740 and the compressor 710, and the line connecting the heat exchanger 720 and the expansion valve 730. In other words, the SLHX 760 is positioned between the line connecting the evaporator 740 and the compressor 710 (herein referred to as the vapour line), and the line connecting the heat exchanger 720 and the expansion valve 730 (herein referred to as the liquid line).

In use, the SLHX transfers heat from the liquid line, after the heat exchanger 720, to the vapour line, after the evaporator 740. This results in two effects taking place: a first which improves the efficiency of the circuit 700; and a second which reduces the efficiency of the circuit 700.

Firstly, advantageously, on the liquid line side—that is, the high pressure side—the sub-cooling of the liquid refrigerant is increased. This is because extra heat is rejected to the liquid expansion side, which reduces the temperature of the refrigerant entering the expansion valve 730. This additional sub-cooling leads to lower inlet quality in the evaporator 740 after the expansion valve 730 process. This increases the enthalpy difference and so the capacity of the refrigerant to absorb heat in the evaporator 740 stage is increased. Accordingly, the performance of the evaporator 740 is improved.

Secondly, disadvantageously, on the vapour line side—that is, the low pressure side—the refrigerant exiting the evaporator 740 receives extra heat from the liquid line, which effectively increases the superheating. This results in a higher suction line temperature. As a result of the higher suction line temperature to the compressor 710, the enthalpy difference of the compression process increases. This increases the compressor power required to compress the refrigerant. Accordingly, this has a detrimental effect on the system performance.

In summary both the first and second effects of improved evaporator capacity and improved compressor power requirements need to be considered in order to determine whether or not introducing a SLHX results in an overall beneficial effect. For certain refrigerants, such as R717, the use of a SLHX leads to an overall reduction of the system efficiency. However, in contrast, use of a SLHX in accordance with the present invention, including each of Systems 1-4 and in particular such systems 200 and 300 herein and as illustrated and described in connection with FIG. 7 hereof, leads to an overall positive and unexpectedly beneficial effect.

Supporting Data

Data intended to demonstrate the technical effects of the various arrangements of this disclosed and to aid the person skilled in the art in putting the various arrangements in to practice will now be presented.

Table 1 shows the overall GWP for varying proportions of R515A and R744 refrigerants in the refrigeration system: 1 being the maximum combined value i.e. 100%. According to the 5th Intergovernmental Panel on Climate Change, R515A has a GWP of 403 and R755 a GWP of 1. Consequently, the overall GWP for 0 proportion R515A and 1 proportion R744 is 1 as [(1×1)=1]. Conversely, the overall GWP for 0.05 proportion R515A and 0.95 proportion R755 is 21.1 since [(0.05×403)+(0.95×1)=21.1]. In this way Table 1 shows the charge ratio restrictions considering GWP criteria.

TABLE 1

| R515A | R744 | Overall GWP |
|---|---|---|
| 0 | 1 | 1 |
| 0.05 | 0.95 | 21.1 |
| 0.1 | 0.9 | 41.2 |
| 0.15 | 0.85 | 61.3 |
| 0.2 | 0.8 | 81.4 |
| 0.25 | 0.75 | 101.5 |
| 0.3 | 0.7 | 121.6 |
| 0.31 | 0.69 | 125.62 |
| 0.32 | 0.68 | 129.64 |
| 0.33 | 0.67 | 133.66 |
| 0.34 | 0.66 | 137.68 |
| 0.35 | 0.65 | 141.7 |
| 0.36 | 0.64 | 145.72 |
| 0.37 | 0.63 | 149.74 |
| 0.38 | 0.62 | 153.76 |
| 0.39 | 0.61 | 157.78 |
| 0.4 | 0.6 | 161.8 |
| 0.5 | 0.5 | 202 |
| 0.6 | 0.4 | 242.2 |
| 0.7 | 0.3 | 282.4 |
| 0.8 | 0.2 | 322.6 |

TABLE 1-continued

| R515A | R744 | Overall GWP |
|---|---|---|
| 0.9 | 0.1 | 362.8 |
| 1 | 0 | 403 |

Figure 6:
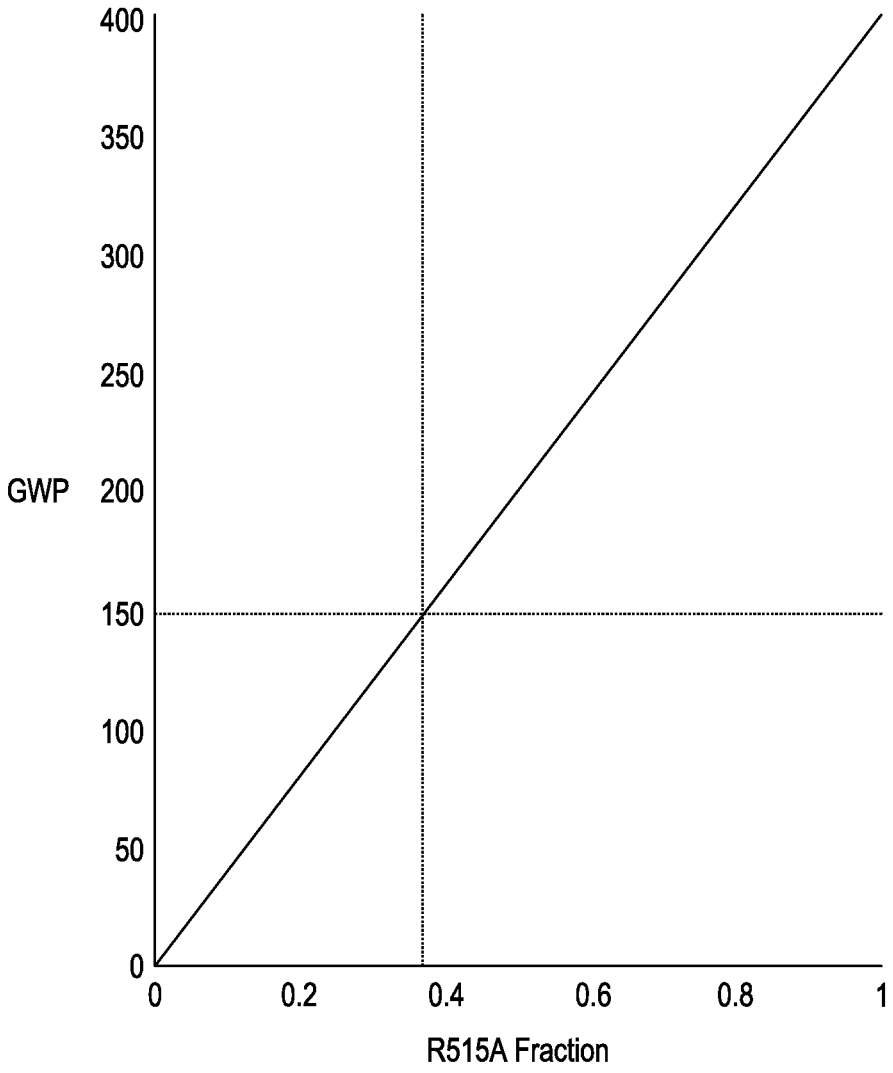
FIG. 6 shows a graph of global warming potential for a refrigeration system having R515A and R744 refrigerants.

FIG. 6 shows the data in Table 1 in graphical form. The proportion of R515A is shown on the x-axis, and the overall GWP is shown on the y-axis. It is clear from this graph that there is a direct proportional relationship between the relative proportions of R515A and R744 and GWP: as the proportion of R515A increases, as does the GWP for the system. This is because R515A has a much higher GWP than R744, The directly proportional relationship is shown by the straight line on the graph which goes from 1 GWP at 0 proportion R515A to around 400 GWP at 1 proportion R515A. It is clear from this graph that the maximum allowed system GWP of 150 in preferred embodiments is found at around 0.35 weight proportion R515A.

Example 1

Table 2a shows blends not previously mentioned in this disclosure but which are be considered in Table 2b.

TABLE 2a

| Refrigerant | R1234ze(E)(E) (wt %) | R1233zd(E) (wt %) | CF3I (wt %) | R227ea (wt %) |
|---|---|---|---|---|
| A1 | 78.0% | 2.0% | 20% | n/a |
| A2 | 84.0% | 2.0% | 9.6% | 4.4% |

Table 2b shows a comparison of characteristics of the comparative refrigeration system described in reference to FIG. 1B but without a mechanical subcooler ('Comparative Example'); the comparative refrigeration system described in reference to FIG. 1B with the mechanical subcooler ('Comparative example with mechanical subcooler'); the cascaded refrigeration system described in reference to FIG. 2 ('Option 1'); and the flooded cascaded refrigeration circuit described in reference to FIG. 4 ('Option 2'), for different combinations of refrigerants.

TABLE 2b

| Systems | Medium temperature (second refrigeration circuit) | Low temperature (first refrigeration) | Power [kW] | Capacity [kW] | COP [-] | Relative COP % of R404A (% of R404A w mech SC) |
|---|---|---|---|---|---|---|
| Comparative example | R404A | | 54.8 | 100 | 1.823487 | 100% |
| Comparative example with mechanical subcooler | | | 49.6 | 100 | 2.016129 | 110.6% (100%) |
| Option 1 | R1234ze(E) | R744 | 46.8 | 100 | 2.14 | 117.2% (106.0%) |
| | R515A | R744 | 47.1 | 100 | 2.12 | 116.5% (105.4%) |
| | A1 | R744 | 46.6 | 100 | 2.14 | 117.6% (106.3%) |
| | A2 | R744 | 46.8 | 100 | 2.14 | 117.2% (106.0%) |
| Option 2 | R1234ze(E) | R744 | 46.0 | 100 | 2.17 | 119.2% (107.8%) |
| | R515A | R744 | 46.2 | 100 | 2.16 | 118.7% (107.3%) |
| | A1 | R744 | 46.0 | 100 | 2.17 | 119.2% (107.8%) |
| | A2 | R744 | 46.1 | 100 | 2.17 | 119.1% (107.7%) |

Table 2b includes information on the coefficient of performance (COP) of each system. The COP is the ratio of useful cooling output from the system to work input to the system. Higher COPs equate to lower operating costs. The relative COP is the COP relative to the comparative example refrigeration system.

It is clear from Table 2b that the flooded cascaded refrigeration circuit achieves the best COP as its values for COP are in all cases higher than for the other systems.

The results shown in Table 2b are based on the below assumptions, where MT means medium temperature (second refrigeration circuit) and LT means low temperature (first refrigeration circuit) and units are as given.

Comparative example R404A combined MT and LT system

Load distribution

LT: ⅓ (33,000 W)

MT: ⅔ (67,000W)

Volumetric efficiency: 95% for both MT ad LT

Isentropic efficiency
- R404A: MT/LT, 0.72/0.68
- R134a: MT, 0.687
- R744: LT, 0.671

Condensing temperature: 105 F

MT evaporation temperature: 20 F (22 F for Self-contained units due to lower pressure drop)

LT evaporation temperature: −25 F

Evaporator superheat: 10 F

Suction line temperature rise
- Comparative example: MT: 25 F; LT: 50 F
- Cascade/self-contained: MT: 10 F; LT: 25 F (Self-contained units have shorter lines and therefore less heat infiltration)
- Cascade/pumped: MT: 10 F; LT: 25 F SLHX efficiency when used: 35%

Mechanical sub cooler outlet temperature: 50 F

It will be appreciated that the LT load of this example (33,000 watts) will be provided according to the preferred aspects of the present invention by cumulative power rating of numerous small compressors. For example, if the LT portion of the refrigeration systems uses compressors rated at about 1500 watts (about 2 horsepower) numerous (e.g., 20) of such small compressors will be used according to the present invention. In contrast, it would be contemplated that the compressor load carried by the medium temperature system could be handled by a series of larger compressors (having a power rating of 5 horse power or greater) to provide the 67,000 watts (about 90 horse power) of cooling.

Table 3 shows a comparison of characteristics of the comparative example refrigeration system described in reference to FIG. 1 and the cascaded refrigeration system described in reference to FIG. 2 for different combinations of refrigerants in the cascaded refrigeration system and with suction line liquid line (SLHX) in the second refrigeration circuits (the medium temperature stage). Like Table 2b, Table 3 includes information on the actual and relative COPs of each system.

TABLE 3

| Systems | Medium temperature (second refrigeration circuit) | Low temperature (first refrigeration circuit) | Power [kW] | Capacity [kW] | COP [-] | Relative COP % of R404A (% of R404A w mech SC) |
|---|---|---|---|---|---|---|
| Comparative Example | R404A | | 54.8 | 100 | 1.823 | 100% |
| Comparative Example with mechanical subcooler | | | 49.6 | 100 | 2.016 | 110.6% (100%) |
| Option 1 with SLHX | R1234ze(E) | R744 | 43.92 | 100 | 2.277 | 124.9% (112.9%) |
| | R515A | R744 | 44.05 | 100 | 2.270 | 124.5% (112.6%) |
| | A1 | R744 | 43.97 | 100 | 2.274 | 124.7% (112.8%) |
| | A2 | R744 | 43.98 | 100 | 2.274 | 124.7% (112.8%) |

It is clear from Table 3 that higher COP is achieved by using the SLHX compared to not using the SLHX. This is demonstrated by the values for COP being higher in Table 5 than in Table 2b for the same combinations of refrigerant in the cascaded refrigerant system.

Example 2A—Preferred Combinations with R-1234yf and Suction Line Heat Exchanger

Table 4a shows blends which are used in connection with the test work described in this example (with each of the amounts indicated below understood to be preceeded by the word "amount," and also preferably understood to be modified by +/−0.5 wt %).

TABLE 4a

| Refrigerant | R1234ze(E) (wt %) | R1233zd(E) (wt %) | R1234yf (wt %) | CF3I (wt %) | R227ea (wt %) |
|---|---|---|---|---|---|
| A1 | 78.0% | 2.0% | n/a | 20% | n/a |
| A2 | 84.0% | 2.0% | n/a | 9.6% | 4.4% |
| FH | Na | Na | 70% | 30% | na |
| R515A | 88% | | | | 12% |
| R515B | 91.1% | | | | 8.9% |

Table 4b below shows a comparison of characteristics of the comparative refrigeration system of the type described in detail now in connection with FIG. 7.

Figure 7:
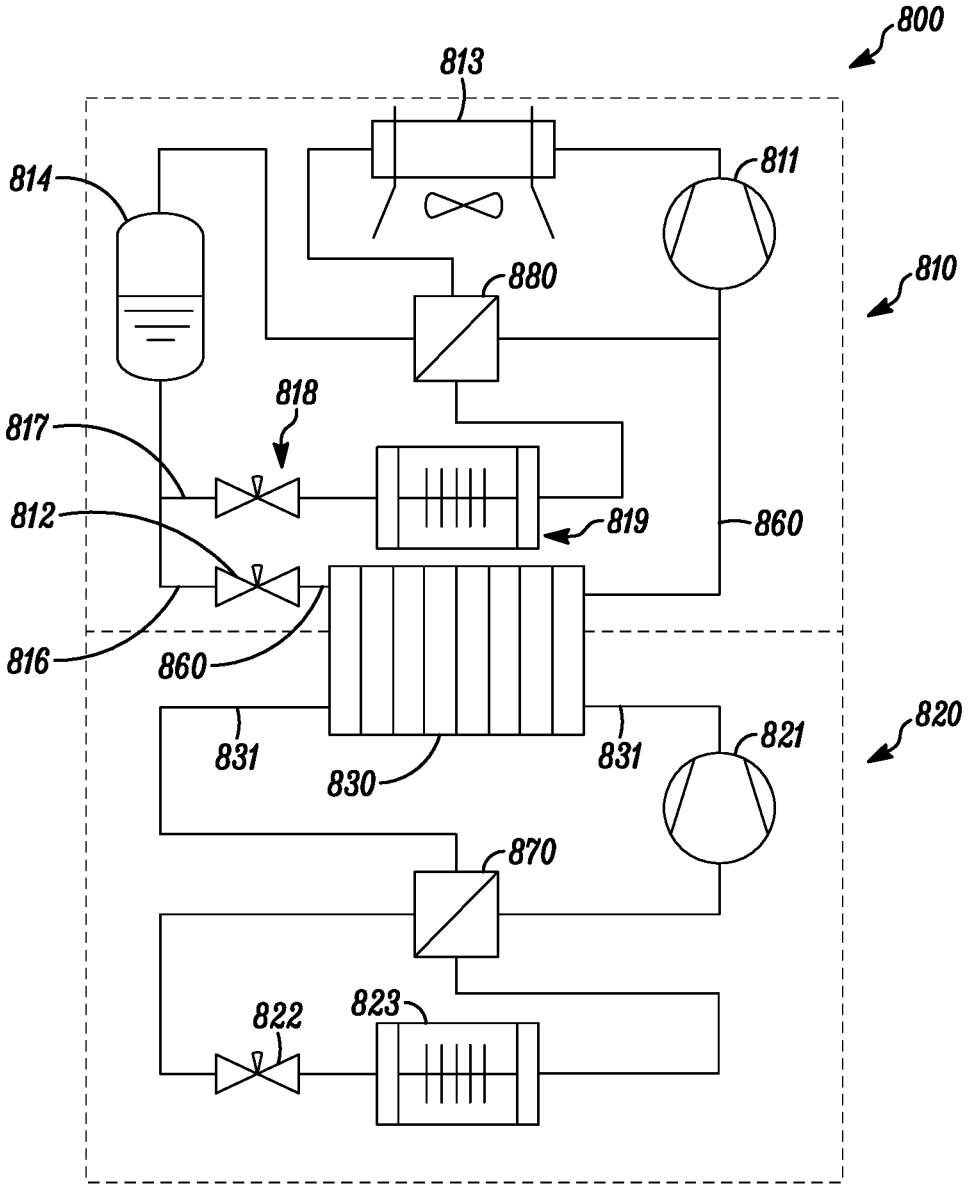
FIG. 7 shows a cascaded refrigeration system according to preferred embodiments of the present invention.

FIG. 7 shows a cascaded refrigeration system 800. More specifically, FIG. 7 shows a refrigeration system 800 which is accordance with the systems of the present invention, including but not limited to each of Systems 1-4, and which has a first refrigeration circuit 820. Each of the first refrigeration circuits 820 has an evaporator 823, a compressor 821, a heat exchanger 830 and an expansion device (e.g., expansion valve) 822. While each of the compressors, evaporators, heat exchangers and expansion devices in the circuit are illustrated by a single icon, it will be appreciated that the compressor, the evaporator, the heat exchanger, expansion valve, etc can each comprise a plurality of such units. In each circuit 820, the evaporator 823, the compressor 821, the heat exchanger 830 and the expansion device 822 are connected in series with one another in the order listed, with the exception that, as illustrated in FIG. 7, a suction line heat exchanger 870 is connected on the heat rejecting side, downstream from the heat exchanger 830 and upstream of the expansion device 822 and on the heat absorbing side downstream of evaporator 823 and upstream of the compressor 821, in accordance with the flow scheme depicted and explained in connection with FIG. 5B. The first refrigeration circuit 820 is preferably included within a separate respective refrigeration unit (not shown). In this example, the first refrigeration unit is a freezer unit and the freezer unit houses one of the first refrigeration circuits. In this way, each refrigeration unit comprises a self-contained and dedicated refrigeration circuit. The refrigeration units (not shown), and therefore the first refrigeration circuit 820, can be arranged and located in area accessible by the public such as, for example, on a sales floor (not shown) of a supermarket.

In this example, the refrigerant contained in the first refrigeration circuit 820 is a low GWP refrigerant R-1234yf.

The refrigeration system 800 also has a second refrigeration circuit 810. The second refrigeration circuit 810 has a compressor 811, a condenser 813, and a fluid receiver 814. The compressor 811, the condenser 813 and the fluid receiver 814 are connected in series and in the order given, with the exception that in certain arrangements as illustrated in FIG. 7 and described below a suction line heat exchanger 880 is connected, on the heat rejecting side, downstream from the condenser 813 and upstream of the fluid receiver 814 and on the heat absorbing side downstream of evaporator 819 and upstream of the compressor 811 in accordance with the flow scheme depicted and explained in connection with FIG. 5B. While each of the compressors, condensers, fluid receivers, etc. in the second circuit are illustrated by a single icon, it will be appreciated that the compressor, the evaporator, the heat exchanger, expansion device, etc. can each comprise a plurality of such units. The second refrigeration circuit 810 also has two parallel connected branches: medium temperature cooling branch 817 and one low temperature cooling branch 816. The branch 817 is connected between the fluid receiver 814 and the compressor 811 and has an expansion device (such as for example an expansion valve) 818 and an evaporator 819. The expansion device 818 and evaporator 819 are connected in series and as described above between the fluid receiver 814 and the suction line heat exchanger 880, which then feeds compressor 811. The low temperature cooling branch 816 has an expansion device (such as for example an expansion valve) 812 and an interface, in the form of inlet and outlet piping, conduits, valves and the like (represented collectively as 860) which bring the second refrigerant to and from each the heat exchanger 830 of the first refrigeration circuit 820. The low temperature cooling branch 816 interfaces the heat exchanger 830 of the first refrigeration circuit 820 at a circuit interface location 831.

In this example, the refrigerants identified in Table 4a are each used in a separate test in the medium temperature refrigeration circuit 810. Usefully, these blends are non-flammable refrigerant, which improves safety, and further advantageously, each blend has a low GWP, making it an environmentally friendly solution.

Use of the preferred embodiments as illustrated in FIG. 7 can be summarized as follows:

- the first refrigeration circuit 820 absorbs heat via the evaporator 823 to provide low temperature cooling to a space to be chilled (not shown);
- the second refrigeration circuit 810 absorbs heat from the heat exchanger 830 to cool the first refrigeration circuits 820;
- the second refrigeration circuit 810 absorbs heat at the evaporators 819 to provide medium temperature cooling to spaces to be chilled (not shown); and
- heat is removed from the refrigerant blend in the second refrigeration circuit 810 in the chiller 819.

A number of beneficial results can be achieved using arrangements of the present invention of the type shown in FIG. 7, particularly from each first refrigeration circuit 830 being self-contained in a respective refrigeration unit.

For example, installation and uninstallation of the refrigeration units and the overall cascaded refrigeration system 800 is simplified. This is because the refrigeration units, with their built-in, self-contained first refrigeration circuits 820, can be easily connected or disconnected with the second refrigeration circuit 810, with no modification to the first refrigeration circuit 820. In other words, the refrigeration units may simply be 'plugged' in to, or out of, the second refrigeration circuit 810.

Another advantage is that each refrigeration unit, including the respective first refrigeration circuit 820, can be factory tested for defaults before being installed into a live refrigeration system 800. This mitigates the likelihood of faults, which can include leaks of potentially harmful refrigerants. Accordingly, reduced leak rate can be achieved.

Another advantage is that the lengths of the first refrigeration circuits 820 can be reduced since each circuit is arranged in its respective refrigeration unit, and does not extend between a series of units. The reduced circuit length can result in improved efficiency as there is reduced heat infiltration in shorter lines due to reduced surface area. Further, reduced circuit length can also result in reduced pressure drop, which improves the system 800 efficiency.

The reduced circuit length, and the provision of the circuits self-contained within respective refrigeration units, also provides the ability to use more flammable refrigerants such as R1234yf which applicants have come to appreciate is a highly beneficial result. This is because both the likelihood of the refrigerant leaking is reduced (as discussed above) and because, even if the refrigerant were to leak, the leak would be contained to the relatively small area and containable area of the respective refrigeration unit, and because of the small size of the units, only a relatively small amount of refrigerant charge is used. In addition, this arrangement would permit the use of relatively low cost flame mitigation contingency procedures and/or devices since the area containing potentially flammable materials is much smaller, confined and uniform. Such more flammable refrigerants can have lower global warming potential (GWP). Advantageously therefore, governmental and societal targets for the use of low GWP refrigerants may be met and potentially even exceeded without compromising on safety of the system.

Another advantage is that each first refrigeration circuit 820 may only cool their respective refrigeration unit. This means that the load on each first refrigeration circuit 820 may remain relatively constant. That is, constant conditions are applied to the condensing 831 and evaporating 823 stages of the first refrigeration circuit 820. This allows for the simplification of the design of the first refrigeration circuit 820 in that passive expansion devices 822, such as capillary tubes or orifice tubes, can be used. This is in contrast to more complex circuits where electronic expansion devices and thermostatic expansion valves need to be used. Since the use of such complex devices is avoided, costs can be reduced and reliability can be increased.

Furthermore, importantly, the provision of a flooded heat exchanger in the second refrigeration circuit according to such embodiments results in improved heat transfer between the first and second circuits. Accordingly, the efficiency of the overall refrigeration system is improved.

There are several advantages that may arise from circuit interface locations being coupled in parallel with other circuit interface locations. One advantage may be that resilience is provided in the system since a fault associated with or suffered at one circuit interface location will not impact other circuit interface locations. This is because each circuit interface location is serviced by a respective branch of the second refrigeration circuit. Another advantage may be that heat transfer efficiency between first and second refrigeration circuits is improved because the temperature of the second refrigerant before each circuit interface location can be kept relatively constant. In contrast, if two circuit interface locations were coupled in series, the temperature of the refrigerant in the second refrigeration circuit may be higher before the downstream circuit interface location, than before the upstream circuit interface location.

The results of system testing as described above in connection with the blends in Table 4a are summarized below in Table 4b:

TABLE 4b

| Systems | Medium temperature | Low temperature | Power [kW] | Capacity [kW] | COP [-] | Relative COP % of R404A |
|---|---|---|---|---|---|---|
| R404A | R404A | | 49.0 | 100 | 2.04 | 100% |
| Cascade with R1234yf | R515A | R1234yf | 38.8 | 100 | 2.58 | 126.5% |
| | R515B (R1234ze(E)/ R227ea) (91.1/8.9) | R1234yf | 38.7 | 100 | 2.58 | 126.5% |
| | FH (R1234yf/CF3I) (70/30) | R1234yf | 39.3 | 100 | 2.54 | 124.7% |
| | A1 | R1234yf | 38.8 | 100 | 2.58 | 126.3% |
| | A2 | R1234yf | 38.8 | 100 | 2.58 | 126.4% |

Table 4b includes information on the coefficient of performance (COP) of each system. The COP is the ratio of useful cooling output from the system to work input to the system. Higher COPs equate to lower operating costs. The relative COP is the COP relative to the comparative example refrigeration system.

As can be seen from the test results above, in each of the combinations used in the preferred system arrangement as described herein in general and in specific in connection with system of FIG. 7, dramatically and unexpectedly improved COP and reduced energy consumption are achieved.

The results shown in Table 4b are based on the particular system test conditions as described below, where MT means medium temperature (second refrigeration circuit) and LT means low temperature (first refrigeration circuit) and units are as given.

- Comparative example R404A combined MT and LT system
- Load distribution
  - LT: ⅓ (33,000 W)
  - MT: ⅔ (67,000 W)
- Volumetric efficiency: 95% for both MT ad LT
- Isentropic efficiency
  - R404A: MT/LT, 0.72/0.68
- Condensing temperature: 105 F
- MT evaporation temperature: 20 F (22 F for Self-contained units due to lower pressure drop)
- LT evaporation temperature: −20 F
- Evaporator superheat: 10 F
- Suction line temperature rise
  - Comparative example: MT: 25 F; LT: 50 F
  - Cascade/self-contained without the suction line heat exchanger (SLHX): MT: 10 F; LT: 25 F
  - Cascade/self-contained with the suction line heat exchanger (SLHX): MT: 10 F; LT: 15 F
- SLHX efficiency when used: 65%
- Mechanical sub cooler outlet temperature: 50 F It will be appreciated that the LT load of this example (33,000 watts) will be provided according to the preferred aspects of the present invention by cumulative power rating of numerous small compressors. For example, if the LT portion of the refrigeration systems uses compressors rated at about 1500 watts (about 2 horsepower) numerous (e.g., 20) of such small compressors will be used according to the present invention. In contrast, it would be contemplated that the compressor load carried by the medium temperature system could be handled by a series of larger compressors (having a power rating of 5 horse power or greater) to provide the 67,000 watts (about 90 horse power) of cooling.

Example 2B—Preferred Combinations with R-455A and Suction Line Heat Exchanger

Example 2A is repeated, except that in each case the R-1234yf refrigerant in the first refrigeration circuit is replaced with R-455A. The results are reported in Table 4c below:

TABLE 4c

| Systems | Medium temperature | Low temperature | Power [kW] | Capacity [kW] | COP [-] | Relative COP % of R404A |
|---|---|---|---|---|---|---|
| R404A | R404A | | 49.0 | 100 | 2.04 | 100% |
| Cascade with R455A | R515A | R455A | 38.9 | 100 | 2.57 | 126.0% |
| | R515B (R1234ze(E)/ R227ea) (91.1/8.9) | R455A | 38.9 | 100<br>100 | 2.57 | 126.0% |
| | FH (R1234yf/CF3I) (70/30) | R455A | 39.5 | | 2.53 | 124.2% |
| | Al | R455A | 39.0 | 100 | 2.57 | 125.8% |
| | A2 | R455A | 38.9 | 100 | 2.57 | 125.9% |

As can be seen from the test results above, in each of the combinations used in the preferred system arrangement as described herein in general and in specific in connection with system of FIG. 7, dramatically and unexpectedly improved COP and reduced energy consumption are achieved.

Example 2C—Preferred Combinations with Propane and Suction Line Heat Exchanger

Example 2A is repeated, except that in each case the R-1234yf refrigerant in the first refrigeration circuit is replaced with Propane. The results are reported in Table 4d below:

TABLE 4d

| Systems | Medium temperature | Low temperature | Power [kW] | Capacity [kW] | COP [-] | Relative COP % of R404A |
|---|---|---|---|---|---|---|
| R404A | R404A | | 49.0 | 100 | 2.04 | 100% |
| Cascade with R455A | R515A | Propane | | ~100 | >>2.04 | >>100% |
| | R515B (R1234ze(E)/ R227ea) (91.1/8.9) | Propane | <<49 | ~100 | >>2.04 | >>100% |
| | FH (R1234yf/CF31) (70/30) | Propane | <<49 | ~100 | >>2.04 | >>100% |
| | Al | Propane | <<49 | ~100 | >>2.04 | >>100% |
| | A2 | Propane | <<49 | ~100 | >>2.04 | >>100% |

As can be seen from the results above, in each of the combinations used in the preferred system arrangement as described herein in general and in specific in connection with system of FIG. 7, dramatically and unexpectedly improved COP and reduced energy consumption are achieved.

Example 3A—Preferred Combinations with R1234yf and No Suction Line Heat Exchanger Each of the refrigerant blends as described in Table 4a above are tested in the medium temperature circuit with R-1234yf in the low temperature circuit. The particular circuit used is as illustrated in FIG. 2 and the conditions are as described above in connection with Example 2A, The results achieved are reported in Table 5a below:

TABLE 5a

| Systems | Medium temperature | Low temperature | Power [kW] | Capacity [kW] | COP [-] | Relative COP % of R404A |
|---|---|---|---|---|---|---|
| R404A | R404A | | 49.0 | 100 | 2.04 | 100% |
| Cascade with R1234yf | R515A | R1234yf | 43.7 | 100 | 2.29 | 112.1% |
| | (R1234ze(E)/ R227ea) (91.1/8.9) | R1234yf | 43.6 | 100 | 2.29 | 112.3% |
| | R1234yf/CF3I (70/30) | R1234yf | 44.7 | 100 | 2.24 | 109.7% |
| | A1 | R1234yf | 43.3 | 100 | 2.31 | 113.1% |
| | A2 | R1234yf | 43.5 | 100 | 2.30 | 112.7% |

It is clear from Table 5a above compared to Table 4b above that higher COP and higher capacity is achieved by using the SLHX compared to not using the SLHX. This is demonstrated by the values for both COP and capacity being significantly higher in Table 4b than in Table 5a for the same combinations of refrigerant in the cascaded refrigerant system.

Example 3B—Preferred Combinations with R455A and No Suction Line Heat Exchanger

Each of the refrigerant blends as described in Table 4a above are tested in the medium temperature circuit with R-455a in the low temperature circuit. The particular circuit used is as illustrated in FIG. 2 and the conditions are as described above in connection with Example 2A. The results achieved are reported in Table 5b below:

TABLE 5b

| Systems | Medium temperature | Low temperature | Power [kW] | Capacity [kW] | COP [-] | Relative COP % of R404A |
|---|---|---|---|---|---|---|
| R404A | R404A | | 49.0 | 100 | 2.04 | 100% |
| Cascade with R455A | R515A | R455A | 43.0 | 100 | 2.33 | 114.1% |
| | R1234ze(E)/ R227ea (91.1/8.9) | R455A | 42.9 | 100 | 2.33 | 114.3% |
| | R1234yf/CF3I (70/30) | R455A | 43.9 | 100 | 2.28 | 111.6% |
| | A1 | R455A | 42.6 | 100 | 2.35 | 115.1% |
| | A2 | R455A | 42.7 | 100 | 2.34 | 114.8% |

It is clear from Table 5b above compared to Table 4c above that higher COP and higher capacity is achieved by using the SLHX compared to not using the SLHX. This is demonstrated by the values for both COP and capacity being significantly higher in Table 4b than in Table 5a for the same combinations of refrigerant in the cascaded refrigerant system.

What is claimed is:

1. A cascaded refrigeration system comprising:

(a) a plurality of self-contained low temperature refrigeration circuits, with each low temperature refrigeration circuit contained in a separate low temperature refrigeration unit comprising:

(i) a flammable low temperature refrigerant consisting essentially of HFO-1234yf, R-455A, propane and combinations of two or more of these and having a GWP of about 150 or less;

(ii) a compressor having a horse power rating of about 2 horse power or less; and (iii) a heat exchanger in which said flammable low temperature refrigerant condenses at a temperature of from about −5° C. to about −15° C. to produce a liquid refrigerant; and (iv) a suction line heat exchanger connected upstream of said compressor for cooling said liquid refrigerant from said heat exchanger by adding heat to the gas entering the compressor; and (b) a medium temperature refrigeration circuit comprising a non-flammable medium temperature refrigerant selected from the group consisting of (i) R515A; (ii) R515B; (iii) a mixture consisting essentially of on a weight basis about 70% HFO 1234yf and about 30% CF3I (FH); (iv) a mixture consisting essentially of on a weight basis about 78% R1234ze, about 2% R1233zd and about 20% CF3I (A1); and (v) a mixture consisting essentially of on a weight basis about 84% R1234ze, about 2% R1233zd and about 9.6% CF3I (A2), wherein said medium temperature refrigerant evaporates at a temperature below said low temperature refrigerant condensing temperature and in the range of about −5° C. to about −15° C., wherein said medium temperature refrigerant evaporates in said heat exchanger by absorbing heat from said flammable low temperature refrigerant in said low temperature refrigeration circuit.

2. The cascaded refrigeration system of claim 1, wherein two or more of said low temperature refrigeration circuits are each in a separate modular refrigeration unit and wherein said at least two modular refrigeration units are located in a first area open to the public.

3. The cascaded refrigeration system of claim 2, wherein said medium temperature refrigeration circuit includes portions that extend the medium temperature refrigeration circuit between the first area and a second area comprising a machine room.

4. The cascaded refrigeration system of claim 3, wherein the second refrigeration circuit includes portions that extend the second refrigeration circuit to a third area.

5. The cascaded refrigeration system of claim 2 wherein said flammable low temperature refrigerant is R-1234yf and said non-flammable medium temperature refrigerant is A1 and/or A2.

6. The cascaded refrigeration system of claim 2 wherein said flammable low temperature refrigerant is R-455A and said non-flammable medium temperature refrigerant is A1 and/or A2.

7. The cascaded refrigeration system of claim 2 wherein said flammable low temperature refrigerant is R-455A and said non-flammable medium temperature refrigerant is A1 and/or A2.

8. The cascaded refrigeration system of claim 1, wherein each low temperature refrigeration circuit further comprises a fluid expansion device and wherein the fluid expansion device is a capillary tube and/or an orifice tube.

9. The cascaded refrigeration system of claim 8 wherein said flammable low temperature refrigerant is R-1234yf and said non-flammable medium temperature refrigerant is A1 and/or A2.

10. The cascaded refrigeration system of claim 8 wherein said flammable low temperature refrigerant is R-455A and said non-flammable medium temperature refrigerant is A1 and/or A2.

11. The cascaded refrigeration system of claim 8 wherein said flammable low temperature refrigerant is R-455A and said non-flammable medium temperature refrigerant is A1 and/or A2.

12. The cascaded refrigeration system of claim 1 wherein said flammable low temperature refrigerant is HFO1234yf and said non-flammable medium temperature refrigerant is A1 and/or A2.

13. The cascaded refrigeration system of claim 1 wherein said flammable low temperature refrigerant is R-455A and said non-flammable medium temperature refrigerant is A1 and/or A2.

14. The cascaded refrigeration system of claim 1 wherein said flammable low temperature refrigerant is R-455A and said non-flammable medium temperature refrigerant is A1 and/or A2.

15. The cascaded refrigeration system of claim 1 wherein said medium temperature refrigeration circuit is located substantially outside of said low temperature refrigeration circuit.

16. The cascaded refrigeration system of claim 1 wherein said heat exchanger is a flooded heat exchanger.

17. The cascaded refrigeration system of claim 1 wherein said flammable low temperature refrigerant is R-1234yf and said non-flammable medium temperature refrigerant comprises A1.

18. The cascaded refrigeration system of claim 1 wherein said flammable low temperature refrigerant is R-455A and said non-flammable medium temperature refrigerant comprises A2.

19. The cascaded refrigeration system of claim 1 wherein said flammable low temperature refrigerant is R-455A and said non-flammable medium temperature refrigerant comprises A1.

20. The cascaded refrigeration system of claim 1 wherein said flammable low temperature refrigerant is R-455A and said non-flammable medium temperature refrigerant comprises A2.

* * * * *